US007561124B2

(12) United States Patent
Kwak et al.

(10) Patent No.: US 7,561,124 B2
(45) Date of Patent: Jul. 14, 2009

(54) DISPLAY DEVICE AND DRIVING METHOD THEREOF

(75) Inventors: Won-Kyu Kwak, Seongnam-si (KR); Kwan-Hee Lee, Seoul (KR); Keum-Nam Kim, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 825 days.

(21) Appl. No.: 10/963,391

(22) Filed: Oct. 11, 2004

(65) Prior Publication Data

US 2005/0104875 A1 May 19, 2005

(30) Foreign Application Priority Data

Nov. 14, 2003 (KR) ..... 10-2003-0080737

(51) Int. Cl.
*G09G 3/30* (2006.01)

(52) U.S. Cl. ..... 345/76; 345/82; 315/169.1

(58) Field of Classification Search ..... 345/60–68, 345/76–83; 315/169.1–169.4
See application file for complete search history.

(56) References Cited

U.S. PATENT DOCUMENTS

| | | | | |
|---|---|---|---|---|
| 5,748,160 | A * | 5/1998 | Shieh et al. | 345/82 |
| 6,421,033 | B1 | 7/2002 | Williams et al. | |
| 6,567,063 | B1 | 5/2003 | Okita | |
| 6,618,031 | B1 * | 9/2003 | Bohn et al. | 345/83 |
| 2001/0045944 | A1 | 11/2001 | Iwasaki | |

FOREIGN PATENT DOCUMENTS

| | | |
|---|---|---|
| EP | 0 756 374 A1 | 3/1997 |
| EP | 1 361 562 A2 | 11/2003 |
| JP | 2-118593 | 5/1990 |
| JP | 9-138659 | 5/1997 |
| JP | 2002-82652 | 3/2002 |

(Continued)

OTHER PUBLICATIONS

English translation of Chinese Office action dated Feb. 2, 2007 for corresponding CN 200410089756.4.

(Continued)

*Primary Examiner*—Richard Hjerpe
*Assistant Examiner*—Kimnhung Nguyen
(74) *Attorney, Agent, or Firm*—Christie Parker & Hale LLP

(57) ABSTRACT

A pixel circuit of a display device for realizing a certain color during a display period of time. The pixel circuit includes at least two light emitting elements, each said light emitting element for emitting a corresponding one of colors during the display period of time. An active element is commonly connected to the at least two light emitting elements to drive the at least two light emitting elements. The active element time-divisionally drives the at least two light emitting elements during the display period of time, such that each said light emitting element emits the corresponding one of the colors per a sub display period of time. The at least two light emitting elements realize the certain color in the display period of time by time-divisionally emitting the corresponding ones of the colors, each corresponding one of the colors being emitted per the sub display period of time.

41 Claims, 15 Drawing Sheets

FOREIGN PATENT DOCUMENTS

| | | |
|---|---|---|
| JP | 2003-157053 | 5/2003 |
| JP | 2003-280614 | 10/2003 |
| KR | 10-2005-0046467 | 5/2005 |
| KR | 10-2005-0046469 | 5/2005 |
| WO | WO 03/077231 A2 | 9/2003 |

OTHER PUBLICATIONS

Chinese Office action dated Feb. 2, 2007 for corresponding CN 200410089756.4.

European Search Report dated Mar. 26, 2007, for EP 04090399.9, in the name of Samsung SDI Co., Ltd.

Patent Abstracts of Japan, Publication No. 02-118593; Publication Date: May 2, 1990; in the name of Shunpei Yamazaki et al.

Patent Abstracts of Japan, Publication No. 09-138659; Publication Date: May 27, 1997; in the name of Chan-Long Shieh, et al.

Patent Abstracts of Japan, Publication No. 2002-082652; Publication Date: Mar. 22, 2002; in the name of Kazuyuki Shigeta.

Patent Abstracts of Japan, Publication No. 2003-157053; Publication Date: May 30, 2003; in the name of Shinichi Hoshino.

European Search Report dated Mar. 24, 2005, for EP 04090400.5, in the name of Samsung SDI Co., Ltd.

Korean Patent Abstracts, Publication No. 1020050046469 A, dated May 18, 2005, in the name of Won Kyu Kwak.

Korean Patent Abstracts, Publication No. 1020050046467 A, dated May 18, 2005, in the name of Keum Nam Kim et al.

Chinese Notification of Reexamination, date Nov. 12, 2008, for corresponding Chinese application 200410089755.X, with English translation indicating relevance of U.S. references noted in U.S. Office action dated Jul. 5, 2008, namely, 5,748,160 and 6,618,031.

Shi, Y., Digital circuit - Electronic technology - Fundamental knowledge, Fundamentals of Digital Electronic Technology, Tsinghua University Electronics Education Research Team Press, 4th Edition, (1998 reprint 1999), ISBN 7-04-006696-3, with English translation.

Patent Abstracts of Japan, Publication No. 2003-280614; Publication Date: Oct. 2, 2003; in the name of Masahire Sakai et al.

Office Action dated May 22, 2007 for the corresponding Japanese Patent Application No. 2004-330665.

* cited by examiner

DISPLAY DEVICE AND DRIVING METHOD THEREOF

CROSS REFERENCE TO RELATED APPLICATIONS

This application claims priority to and the benefit of Korean Patent Application No. 2003-80737, filed on Nov. 14, 2003 in the Korean Intellectual Property Office, the disclosure of which is incorporated herein by reference in its entirety. This application contains subject matter related to the subject matter disclosed in a commonly owned, co-pending U.S. patent application Ser. No. 10/963,393 entitled "Display Device and Driving Method Thereof," filed on even date herewith.

BACKGROUND OF THE INVENTION

1. Field of the Invention

The present invention relates to a self-emissive organic display device, and more particularly, to a time-divisional driving type organic electroluminescent display device in which red, green and blue light emitting elements are time-divisionally driven by one driving element and a driving method of the time-divisional driving type organic electroluminescent display device.

2. Description of Related Art

Liquid crystal display (LCD) device and organic electroluminescent display device are often used in portable information appliances due to their lightweight and thin characteristics. The organic electroluminescent display device is being noticed as the next generation flat panel display device as the organic electroluminescent display device has better luminance and viewing angle characteristics compared to the LCD device.

Ordinarily, one pixel of an active matrix organic electroluminescent display device includes red, green and blue unit pixels, wherein each red, green and blue unit pixel is equipped with an electroluminescent (EL) device. Red, green and blue organic emitting layers are respectively interposed between anode electrode and cathode electrode in each EL device so that light is emitted from the red, green and blue organic emitting layers by a voltage applied to the anode electrode and cathode electrode.

FIG. 1 illustrates structure of a conventional active matrix organic electroluminescent display device.

Referring to FIG. 1, a conventional active matrix organic electroluminescent display device 10 includes a pixel part 100, a gate line driving circuit 110, a data line driving circuit 120 and a control part (not illustrated in FIG. 1). The pixel part 100 includes a plurality of gate lines 111~11*m* for providing scan signals S1~Sm from the gate line driving circuit 110, a plurality of data lines 121~12*n* for providing data signals DR1, DG1, DB1~DRn, DGn, DBn from the data line driving circuit 120 and a plurality of power supply lines 131~13*n* for providing power supply voltage VDD1~VDDn.

The pixel part 100 includes a plurality of pixels P11~Pmn arranged in a matrix format and connected to the plurality of gate lines 111~11*m*, the plurality of data lines 121~12*n* and the plurality of power supply lines 131~13*n*. Each of the pixels P11~Pmn includes three unit pixels, i.e., corresponding ones of red, green and blue unit pixels PR11~PRmn, PG11~PGmn, PB11~PBmn, so that each of the red, green and blue unit pixels PR11~PRmn, PG11~PGmn, PB11~PBmn is connected to a corresponding one of the gate lines, a corresponding one of the data lines and a corresponding one of the power supply lines.

For example, a pixel P11 includes a red unit pixel PR11, a green unit pixel PG11 and a blue unit pixel PB11, and is connected to a first gate line 111 for providing a first scan signal S1, a first data line 121 and a first power supply line 131.

In more detail, the red unit pixel PR11 of the pixel P11 is connected to the first gate line 111, an R data line 121R for providing an R data signal DR1 and an R power supply line 131R. In addition, the green unit pixel PG11 is connected to the first gate line 111, a G data line 121G for providing a G data signal DG1 and a G power supply line 131G. Further, the blue unit pixel PB11 is connected to the first gate line 111, a B data line 121B for providing a B data signal DB1 and a B power supply line 131B.

FIG. 2 illustrates a pixel circuit P11 of a conventional organic electroluminescent display device. In particular, FIG. 2 illustrates a circuit diagram of the pixel P11 of FIG. 1, which includes red, green and blue unit pixels.

Referring to FIG. 2, the red unit pixel PR11 of the pixel P11 includes a switching transistor M1_R for which the scan signal S1 applied from the first gate line 111 is supplied to a gate, and the data signal DR1 is supplied to a source from the red data line 121R. The red unit pixel PR1*l* also includes a driving transistor M2_R for which a gate is connected to a drain of the switching transistor M1_R, and a power supply voltage VDD1 is supplied to a source from the power supply line 131R. Further, the red unit pixel PR11 includes a capacitor C1_R connected between the gate and the source of the driving transistor M2_R, and a red EL device EL1_R having an anode connected to a drain of the driving transistor M2_R and a cathode connected to a ground voltage VSS.

Similarly, the green unit pixel PG11 includes a switching transistor M1_G for which the scan signal S1 applied from the first gate line 111 is supplied to a gate, and the data signal DG1 is supplied to a source from the green data line 121G. The green unit pixel PG1*l* also includes a driving transistor M2_G for which a gate is connected to a drain of the switching transistor M1_G, and the power supply voltage VDD1 is supplied to a source from the power supply line 131G. Further, the green unit pixel PG11 includes a capacitor C1_G connected between the gate and the source of the driving transistor M2_G, and a green EL device EL1_G having an anode connected to a drain of the driving transistor M2_G and a cathode connected to a ground voltage VSS.

Further, the blue unit pixel PB11 includes a switching transistor M1_B for which the scan signal S1 applied from the first gate line 111 is supplied to a gate, and the data signal DB1 is supplied to a source from the blue data line 121B. The blue unit pixel PB11 also includes a driving transistor M2_B for which a gate is connected to a drain of the switching transistor M1_B, and the power supply voltage VDD1 is supplied to a source from the power supply line 131B. Further, the blue unit pixel PB11 includes a capacitor C1_B connected between the gate and the source of the driving transistor M2_B, and a blue EL device EL1_B having an anode connected to a drain of the driving transistor M2_B and a cathode connected to a ground voltage VSS.

In operation of the above described pixel circuit P11, the switching transistors M1_R, M1_G, M1_B of the red, green and blue unit pixels are driven, and red, green and blue data DR1, DG1, DB1 are applied to the gates of the driving transistors M2_R, M2_G, M2_B from the red, green and blue data lines 121R, 121G, 121B, respectively, when the scan signal S1 is applied to the gate line 111.

The driving transistors M2_R, M2_G, M2_B supply to the EL devices EL1_R, EL1_G, EL1_B a driving current corresponding to the difference between the data signals DR1, DG1, DB1 applied to the gate and the power supply voltage VDD1 respectively supplied from the red, green and blue power supply lines 131R, 131G, 131B. The driving current applied through the driving transistors M2_R, M2_G, M2_B to drive the pixel P11 drives the EL devices EL1_R, EL1_G, EL1_B. The capacitors C1_R, C1_G, C1_B store the data signals DR1, DG1, DB1 applied, respectively, to the red, green and blue data lines 121R, 121G, 121B.

Operations of a conventional organic electroluminescent display device having the above described structure are described as follows in reference to driving waveform diagrams of FIG. 3.

First, the first gate line 111 is driven, and pixels P11~P1*n* connected to the first gate line 111 are driven when the scan signal S1 is applied to the first gate line 111.

In other words, the switching transistors of the red, green and blue unit pixels PR11~PR1*n*, PG11~PG1*n*, PB11~PB1*n* of the pixels P11~P1*n* connected to the first gate line 111 are driven by the scan signal S1 applied to the first gate line 111. Red, green and blue data signals D(S1) (DR1~DRn, DG1~DGn, DB1~DBn) are simultaneously applied to the gates of the driving transistors of the red, green and blue unit pixels, respectively, through the red, green and blue data lines 121R~12*n*R, 121G~12*n*G, 121B~12*n*B composing first to $n^{th}$ data lines 121~112*n* according to the driving of the switching transistors.

The driving transistors of the red, green and blue unit pixels supply a driving current corresponding to the red, green and blue data signals D(S1) (DR1~DRn, DG1~DGn, DB1~DBn) applied to the red, green and blue data lines 121R~12*n*R, 121G~12*n*G, 121B~12*n*B, respectively, to the red, green and blue EL devices. Therefore, the EL devices of the red, green and blue unit pixels PR11~PR1*n*, PG11~PG1*n*, PB11~PB1*n* of the pixels P11~P1*n* connected to the first gate line 111 are simultaneously driven when the scan signal S1 is applied to the first gate line 111.

Similarly, if a scan signal S2 for driving a second gate line 112 is applied, data signals D(S2)(DR1 DRn, DG1 DGn, DB1 DBn) are applied to red, green and blue unit pixels PR21~PR2*n*, PG21~PG2*n*, PB21~PB2*n* of pixels P21~P2*n* connected to the second gate line 112 through red, green and blue data lines 121R~12*n*R, 121G~12*n*G, 121B~12*n*B composing first to nth data lines 121~12*n*.

EL devices of the red, green and blue unit pixels PR21~PR2*n*, PG21~PG2*n*, PB21~PB2*n* of the pixels P21~P2*n* connected to the second gate line 112 are simultaneously driven by a driving current corresponding to the data signals D(S2)(DR1~DRn, DG1~DGn, DB1~DBn).

EL devices of red, green and blue unit pixels PRm1~PRmn, PGm1~PGmn, PBm1~PBmn of pixels Pm1~Pmn connected to the $m^{th}$ gate line 11*m* are simultaneously driven according to red, green and blue data signals D(Sm)(DR1~DRn, DG1~DGn, DB1~DBn) applied to the red, green and blue data lines 121R~12*n*R, 121G~12*n*G, 121B~12*n*B when a scan signal Sm is finally applied to $m^{th}$ gate line 11*m* by repeating the foregoing actions.

Therefore, an image is displayed by sequentially driving pixels (P11~P1*n*)~(Pm1~Pmn) connected to the respective gate lines 111~11*m*, thereby driving pixels during one frame when the scan signals S1~Sm are sequentially applied starting with the first gate line 111 and ending with the $m^{th}$ gate line 11*m*.

However, in an organic electroluminescent display device having this structure, each pixel includes red, green and blue unit pixels, and driving elements for driving red, green and blue EL devices (i.e., a switching thin film transistor, a driving thin film transistor and a capacitor) are respectively arranged per the red, green and blue unit pixels. Further, data lines and power supply lines for supplying data signal and power supply ELVDD to each driving element are respectively arranged per the unit pixels.

Therefore, three data lines and three power supply lines are arranged per pixel, and at least six transistors including three switching thin film transistors and three driving thin film transistors and at least three capacitors are required in each pixel. On the other hand, at least four signal lines are required per red, green and blue unit pixels as a separate emission control line for providing emission control signal is required in case that each pixel is controlled by emission control signals. Therefore, the circuit structure for the pixels in a conventional organic electroluminescent display device is complicated as a plurality of wirings and a plurality of elements are arranged per each pixel, and yield is reduced as probability of generating defects is increased accordingly.

Further, the area of each pixel is reduced as the resolution of the display device is being increased, and not only is it difficult to arrange many elements on one pixel, but also the aperture ratio is reduced accordingly.

SUMMARY OF THE INVENTION

Therefore, in order to solve the foregoing problems associated with the conventional organic electroluminescent display devices, in one exemplary embodiment of the present invention, a pixel circuit of an organic electroluminescent display device appropriate for high accuracy fineness and a driving method for the pixel circuit of the organic electroluminescent display device are provided.

In one exemplary embodiment of the present invention, is provided a pixel circuit of an organic electroluminescent display device capable of improving aperture ratio and yield and a driving method for the pixel circuit of the organic electroluminescent display device.

In one exemplary embodiment of the present invention, is provided a pixel circuit of an organic electroluminescent display device capable of preventing RC delay and voltage drop and a driving method for the pixel circuit of the organic electroluminescent display device.

In one exemplary embodiment of the present invention is provided a pixel circuit of an organic electroluminescent display device capable of simplifying pixel structure and wiring by driving one pixel through one driving element and a driving method of the pixel circuit of the organic electroluminescent display device.

In an exemplary embodiment of the present invention, a pixel circuit of a display device for realizing a certain color during a display period of time includes at least two light emitting elements, each said light emitting element for emitting a corresponding one of colors during the display period of time. An active element is commonly connected to the at least two light emitting elements to drive the at least two light emitting elements. The active element time-divisionally drives the at least two light emitting elements during the display period of time, such that one said light emitting element emits the corresponding one of the colors per a sub display period of time. The at least two light emitting elements realize the certain color in the display period of time by time-divisionally emitting the corresponding ones of the colors.

The display period of time may be one frame, and the sub display period of time may be a sub frame. The one frame may be divided into at least three sub frames, and the at least two light emitting elements may be time-divisionally driven in accordance with at least two of the sub frames inside the one frame. One of the at least two light emitting elements may be driven again or the at least two light emitting elements may be simultaneously driven in a remaining at least one of the sub frames. The remaining at least one sub frame may be arbitrarily selected from the sub frames.

A light emitting time of the at least two light emitting elements may be controlled to control white balance. The display device may be a FED (field emission display) or a PDP (plasma display panel). The at least two light emitting elements may include a red, green, blue or white EL device. A first electrode of the EL device may be connected to the active element, and a second electrode may be connected to a reference voltage(Vss). The EL device may be arranged in stripe type, delta type or mosaic type.

The active element may include at least one switching element for driving the at least two light emitting elements. The at least one switching element may be a thin film transistor, a thin film diode, a diode or a TRS (triodic rectifier switch).

In another exemplary embodiment of the present invention, a pixel circuit of a display device includes red, green and blue EL devices, at least one switching transistor for time-divisionally transmitting red, green and blue data signals, at least one driving transistor for time-divisionally driving the red, green and blue EL devices according to the red, green and blue data signals, and a storage element for storing the red, green and blue data signals. The red, green and blue EL devices are commonly connected to the at least one driving transistor, and time-divisionally emitted correspondingly to the red, green and blue data signals time-divisionally transmitted through the at least one driving transistor in response to red, green and blue emission control signals.

In yet another exemplary embodiment of the present invention, a pixel circuit of an organic electroluminescent display device includes red, green and blue EL devices, a driving unit commonly connected to the red, green and blue EL devices to drive the red, green and blue EL devices, and a sequential control unit for time-divisionally controlling driving of the red, green and blue EL devices. The driving unit may include at least one switching transistor for switching data signals, at least one driving transistor for supplying driving current corresponding to the data signals to the red, green and blue EL devices, and a capacitor for storing the data signals. The driving unit may further include a threshold voltage compensation device for compensating a threshold voltage of the at least one driving transistor. A power supply voltage may be supplied to the at least one driving transistor and the capacitor through a common power supply line, or the power supply voltage may be supplied to the at least one driving transistor and the capacitor through separate power supply lines.

The sequential control unit may include first, second and third control devices for time-divisionally controlling emission of the red, green and blue EL devices by controlling a supply of driving current to the red, green and blue EL devices from a driving transistor using corresponding red, green and blue emission control signals. The first, second and third control devices may include first, second and third thin film transistors in which the corresponding emission control signals are respectively applied to gates, sources are commonly connected to the driving unit, and drains are respectively connected to the red, green and blue EL devices. White balance may be controlled by controlling an active on time of the corresponding emission control signals applied to the sequential control unit, thereby controlling time in which driving current is applied to corresponding said EL devices by the first, second and third control devices.

In yet another exemplary embodiment of the present invention, a pixel circuit of an organic electroluminescent display device includes a first thin film transistor having a gate connected to a gate line, and one of a source and a drain connected to a data line. A second thin film transistor has a gate connected to the other one of the source and the drain of the first thin film transistor, and one of a source and a drain connected to a power supply line. A capacitor is connected between the gate and said one of the source and the drain of the second thin film transistor. A third thin film transistor has one of a source and a drain connected to the other one of the source and the drain of the second thin film transistor, and a first emission control signal applied to a gate. A fourth thin film transistor has one of a source and a drain connected to the other one of the source and the drain of the second thin film transistor, and a second emission control signal applied to a gate. A fifth thin film transistor has one of a source and a drain connected to the other one of the source and the drain of the second thin film transistor, and a third emission control signal applied to a gate. Red, green and blue EL devices have first electrodes connected to the other ones of the source and the drain of the third, fourth and fifth thin film transistors, respectively, and second electrodes commonly grounded.

In yet another exemplary embodiment of the present invention, a pixel circuit of a display device including a plurality of pixels realizes a certain color per display period of time. The pixel circuit includes at least two light emitting elements, each said light emitting element for emitting a corresponding one of colors during a sub display period of time in the certain section. The at least two light emitting elements are sequentially driven time-divisionally during the display period of time, such that each said light emitting element emits the corresponding one of the colors so that the pixel circuit realizes the certain color in the display period of time.

In yet another exemplary embodiment of the present invention, a pixel circuit of a display device including a plurality of pixels realizes a certain color during a display period of time, and includes at least two light emitting elements, each said light emitting element for emitting one of corresponding colors during the display period of time, wherein the pixel circuit realizes the certain color during the display period of time by emitting one of the at least two light emitting elements for a sub display period of time so that the at least two light emitting elements time-divisionally emit the corresponding colors during the display period of time.

In yet another exemplary embodiment of the present invention, a display device includes a plurality of pixels, each said pixel including red, green and blue EL devices, and at least one thin film transistor coupled to the red, green and blue EL devices to drive the red, green and blue EL devices. The red, green and blue EL devices of each said pixel include first electrodes commonly coupled to the at least one thin film transistor and second electrode commonly connected to a reference voltage(Vss). The red, green and blue EL devices are time-divisionally emitted by the at least one thin film transistor in each said pixel.

In yet another exemplary embodiment of the present invention, a flat panel display device includes a plurality of gate lines, data lines and power supply lines, and a plurality of pixels, each said pixel connected to a corresponding said gate line, a corresponding said data line and a corresponding said power supply line. Each of the pixels includes red, green and blue EL devices, at least one thin film transistor commonly coupled to the red, green and blue EL devices to time-divisionally drive the red, green and blue EL devices, and red, green and blue emission controlling thin film transistors connected between the at least one thin film transistor and the red, green and blue EL devices, respectively, to control the red, green and blue EL devices so that the red, green and blue EL devices are time-divisionally emitted inside one frame including a plurality of sub frames, in accordance with the sub frames.

In yet another exemplary embodiment of the present invention, a flat panel display device includes a plurality of gate lines, data lines and power supply lines; and a plurality of pixels. Each said pixel is connected to a corresponding said gate line, a corresponding said data line and a corresponding said power supply line. Each of the pixels includes a first thin film transistor having a gate connected to the corresponding said gate line, and one of a source and a drain connected to the corresponding said data line. A second thin film transistor has a gate connected to the other one of the source and the drain of the first thin film transistor, and one of a source and a drain connected to the corresponding said power supply line. A capacitor is connected between the gate and said one of the source and the drain of the second thin film transistor. A third thin film transistor has one of a source and a drain connected to the other one of the source and the drain of the second thin film transistor, and a first emission control signal applied to a gate. A fourth thin film transistor has one of a source and a drain connected to the other one of the source and the drain of the second thin film transistor, and a second emission control signal applied to a gate. A fifth thin film transistor has one of a source and a drain connected to the other one source and the drain of the second thin film transistor, and a third emission control signal applied to a gate. Red, green and blue EL devices have first electrodes connected to the other ones of the source and the drain of the third, fourth and fifth thin film transistors, respectively, and second electrodes commonly connected to a reference voltage(Vss).

In yet another exemplary embodiment of the present invention, a flat panel display device includes a plurality of gate lines, data lines, emission control lines and power supply lines, and a pixel part including a plurality of pixels, each said pixel connected to a corresponding said gate line, a corresponding said data line, a corresponding said emission control line and a corresponding said power supply line. At least one gate line driving circuit supplies a plurality of scan signals to the gate lines. At least one data line driving circuit time-divisionally supplies red, green and blue data signals to the data lines. At least one emission control signal generating circuit supplies emission control signals to the emission control lines. Each of the pixels includes red, green and blue EL devices, at least one thin film transistor commonly coupled to the red, green and blue EL devices to time-divisionally drive the red, green and blue EL devices, and red, green and blue emission controlling thin film transistors connected between the at least one thin film transistor and the red, green and blue EL devices to control the red, green and blue EL devices so that the red, green and blue EL devices are time-divisionally emitted inside one frame including a plurality of sub frames, in accordance with the sub frames.

In yet another exemplary embodiment of the present invention, is provided a method for driving a flat panel display device including a plurality of gate lines, data lines and power supply lines, and a plurality of pixels, each said pixel connected to a corresponding said gate line, a corresponding said data line and a corresponding said power supply line. Each of the pixels includes at least red, green and blue EL devices. Red, green and blue data are time-divisionally supplied during a display period of time per a sub display period of time through a same data line in each said pixel so that red, green and blue EL devices are sequentially driven to realize a certain color in the display period of time.

In yet another exemplary embodiment of the present invention, is provided a method for driving a flat panel display device including a plurality of gate lines, data lines and power supply lines, and a plurality of pixels, each said pixel connected to a corresponding said gate line, a corresponding said data line and a corresponding said power supply line. Each of the pixels includes at least red, green and blue EL devices. A certain color is realized in a display period of time. Scan signals are generated at the corresponding said gate line per a sub display period of time in the display period of time. Red, green and blue data are time-divisionally applied to the corresponding said data line whenever the scan signals are generated so that red, green and blue driving currents are generated. Red, green and blue EL devices of pixels connected to the corresponding said gate line are time-divisionally driven by R, G and B emission control signals.

BRIEF DESCRIPTION OF THE DRAWINGS

The above and other features of the present invention will become more apparent to those of ordinary skill in the art with the following description in detail of certain exemplary embodiments thereof with reference to the attached drawings in which.

DETAILED DESCRIPTION

Figure 1:
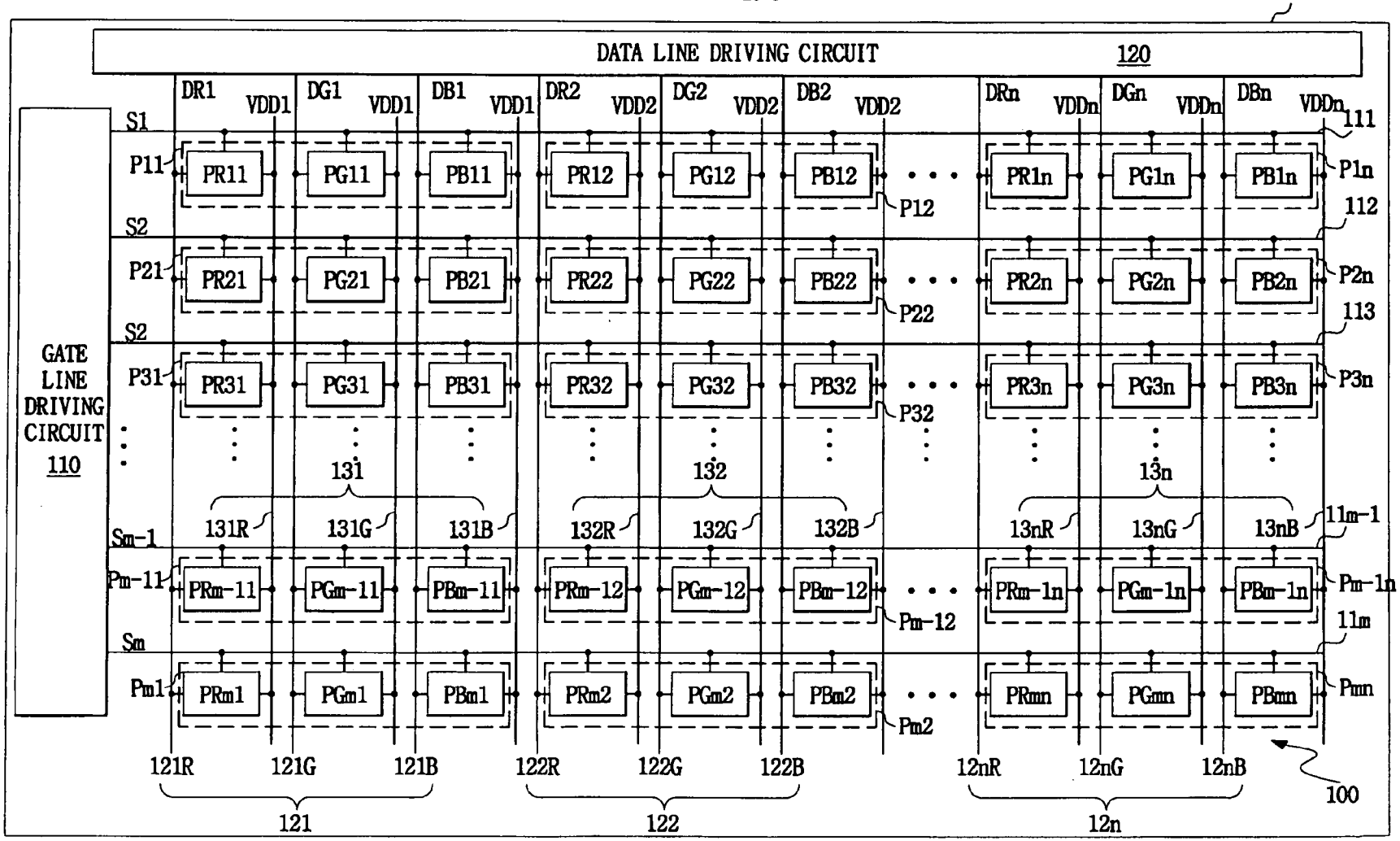
FIG. 1 is a structural view of a conventional organic electroluminescent display device.
Figure 2:
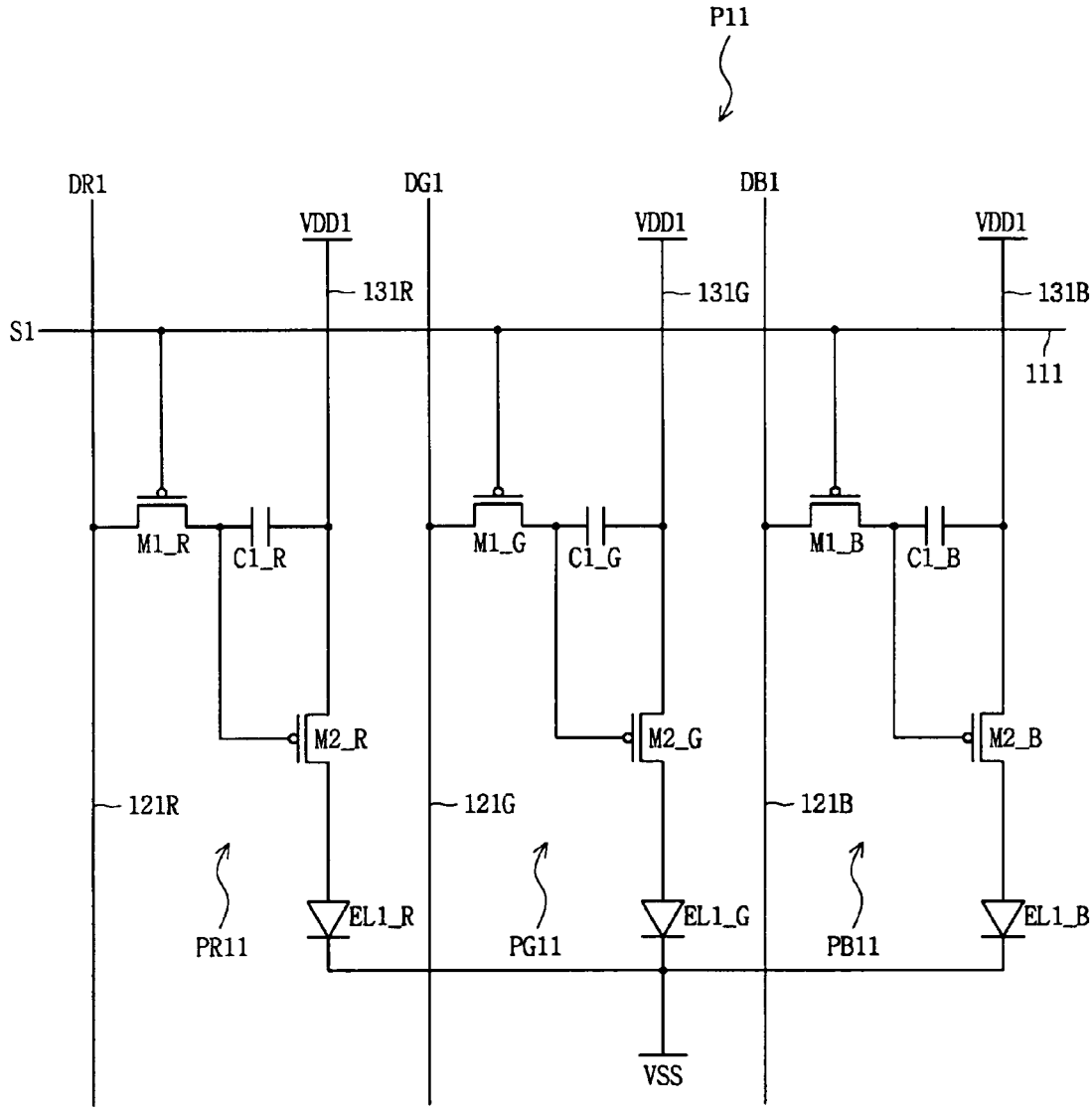
FIG. 2 is a circuit diagram of a pixel circuit of the organic electroluminescent display device of FIG. 1.

The present invention will now be described in detail in connection with certain exemplary embodiments with reference to the accompanying drawings. In the drawings, like reference numerals/characters designate like elements.

Figure 4:
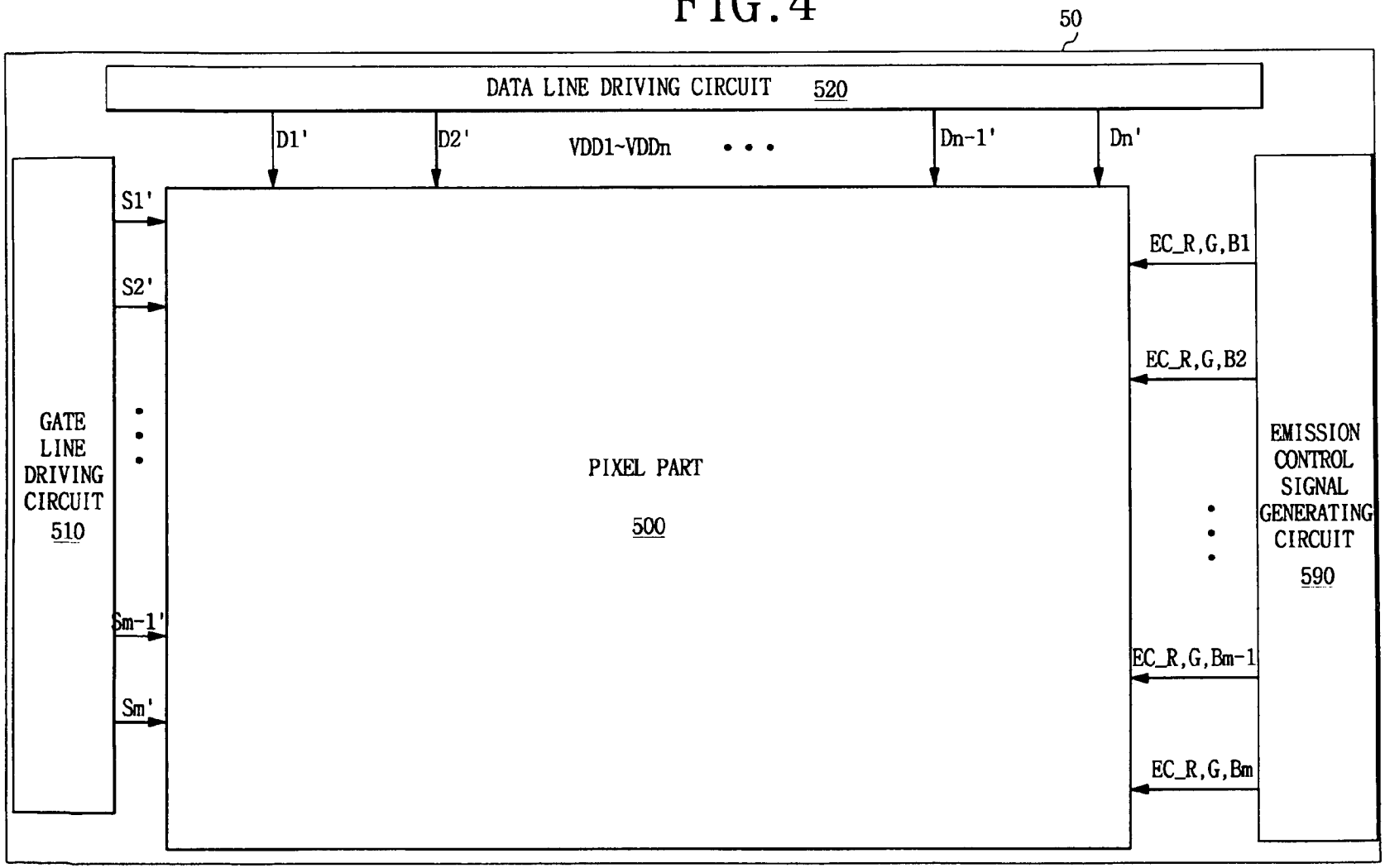
FIG. 4 is a block structural view of an organic electroluminescent display device according to a first exemplary embodiment of the present invention.

FIG. 4 illustrates a block structural view of an organic electroluminescent display device according to a first exemplary embodiment of the present invention.

Referring to FIG. 4, an organic electroluminescent display device 50 according to the first exemplary embodiment includes a pixel part 500, a gate line driving circuit 510, a data line driving circuit 520 and an emission control signal generating circuit 590. The gate line driving circuit 510 sequentially generates scan signals S1'~Sm' to gate lines of the pixel part 500 during one frame. The data line driving circuit 520 sequentially supplies red, green and blue data signals D1'~Dn' to data lines of the pixel part 500 whenever scan signals are applied during one frame. The emission control signal generating circuit 590 sequentially supplies emission control signals EC_R, G, B1~EC_R, G, Bm for controlling emission of red, green and blue EL devices to emission control lines 591~59*m* of the pixel part 500 whenever scan signals are applied during one frame. In this and other embodiments, the EL devices may be arranged in stripe type, delta type or mosaic type. Further, at least one of the gate line driving circuit 510, the data line driving circuit 520 and the emission control signal generating circuit may have a redundancy function.

Figure 5A:
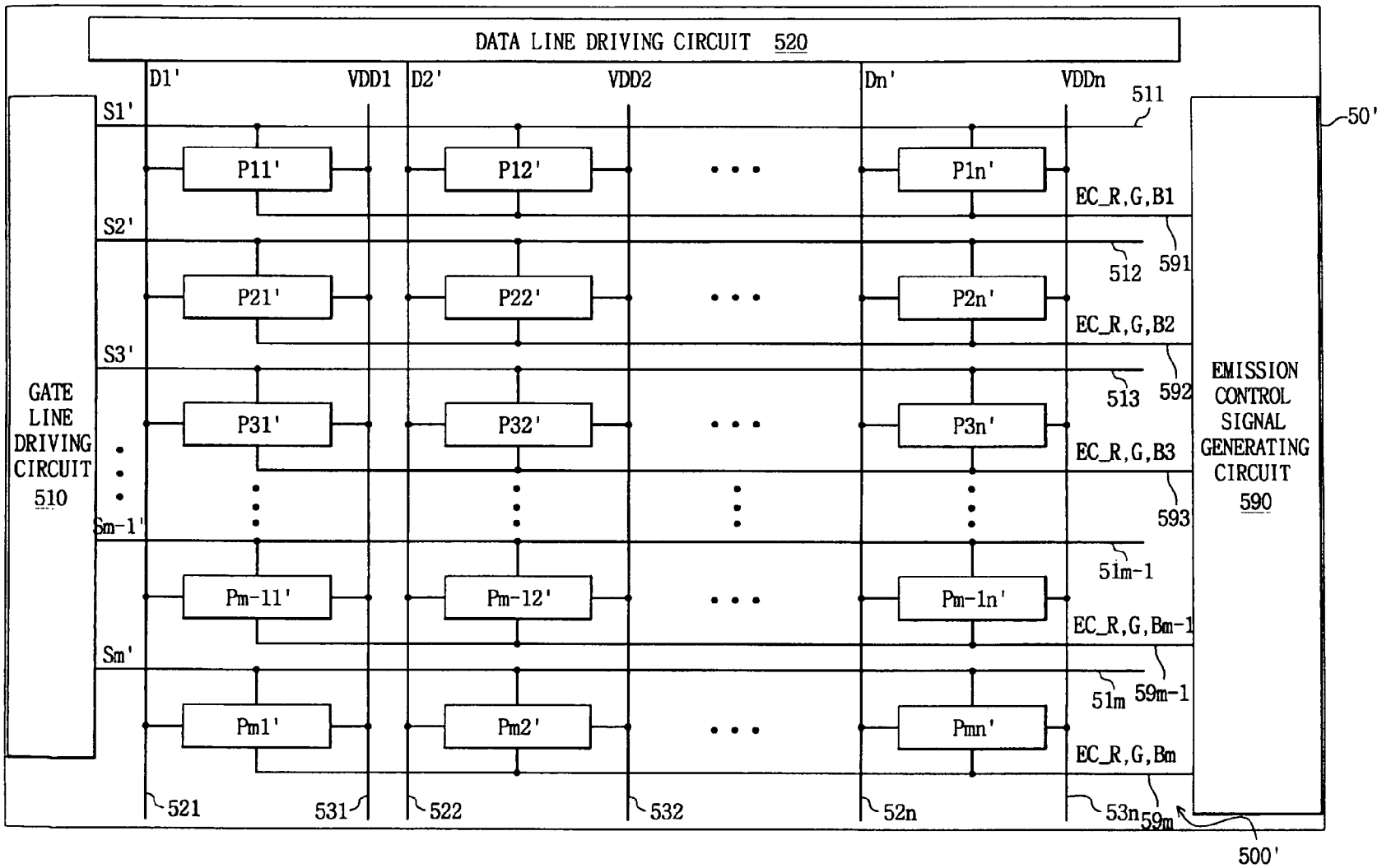
FIG. 5A illustrates a block structural view of a pixel part applicable to the organic electroluminescent display device of FIG. 4.

FIG. 5A illustrates one example of block structure of pixel part in an organic electroluminescent display device according to the first exemplary embodiment of the present invention.

Referring to FIG. 5A, a pixel part 500' of an organic electroluminescent display device 50' includes a plurality of gate lines 511~51*m* to which scan signals S1'~Sm' are supplied from a gate line driving circuit 510, and a plurality of data lines 521~52*n* to which data signals D1'~Dn' are supplied from a data line driving circuit 520. The pixel part 500' also includes a plurality of emission control lines 591~59*m* to which emission control signals EC_R, G, B1~EC_R, G, Bm are supplied from an emission control signal generating circuit 590, and a plurality of power supply lines 531-53*n* for supplying power supply voltage VDD1~VDDn.

The pixel part 500' further includes a plurality of pixels P11'~Pmn' arranged in a matrix format, and connected to the plurality of gate lines 511~51*m*, the plurality of data lines 521~52*n*, the plurality of emission control lines 591~59*m* and the plurality of power supply lines 531~53*n*. Each of the plurality of pixels P11'~Pmn' is connected to one corresponding gate line in the plurality of gate lines 511~51*m*, one corresponding data line in the plurality of data lines 521~52*n*, one corresponding emission control line in the plurality of emission control lines 591~59*m* and one corresponding power supply line in the plurality of power supply lines 531~53*n*.

For example, the pixel P11' is connected to the first gate line 511 for supplying the first scan signal S1', the first data line 521 for supplying the first data signal D1', the first emission control line 591 for supplying the first emission control signal EC_R, G, B1, and the first power supply line 531 for supplying the first power supply voltage VDD1.

Therefore, corresponding scan signals are applied to the pixels P11'~Pmn' through corresponding scan lines, and the corresponding red, green and blue data signals are sequentially supplied to the pixels P11'~Pmn' through corresponding data lines. Further, corresponding red, green and blue emission control signals are sequentially supplied to the pixels P11'~Pmn' through corresponding emission control lines, and corresponding power supply voltage is supplied to the pixels P11'~Pmn' through corresponding power supply lines. Each of the pixels indicates a certain color, such that an image is displayed during one frame by sequentially applying corresponding red, green and blue data signals to the pixels whenever corresponding scan signals are applied to the pixels and sequentially driving red, green and blue EL devices according to red, green and blue emission control signals, thereby sequentially emitting lights corresponding to the red, green and blue data signals.

Figure 6:
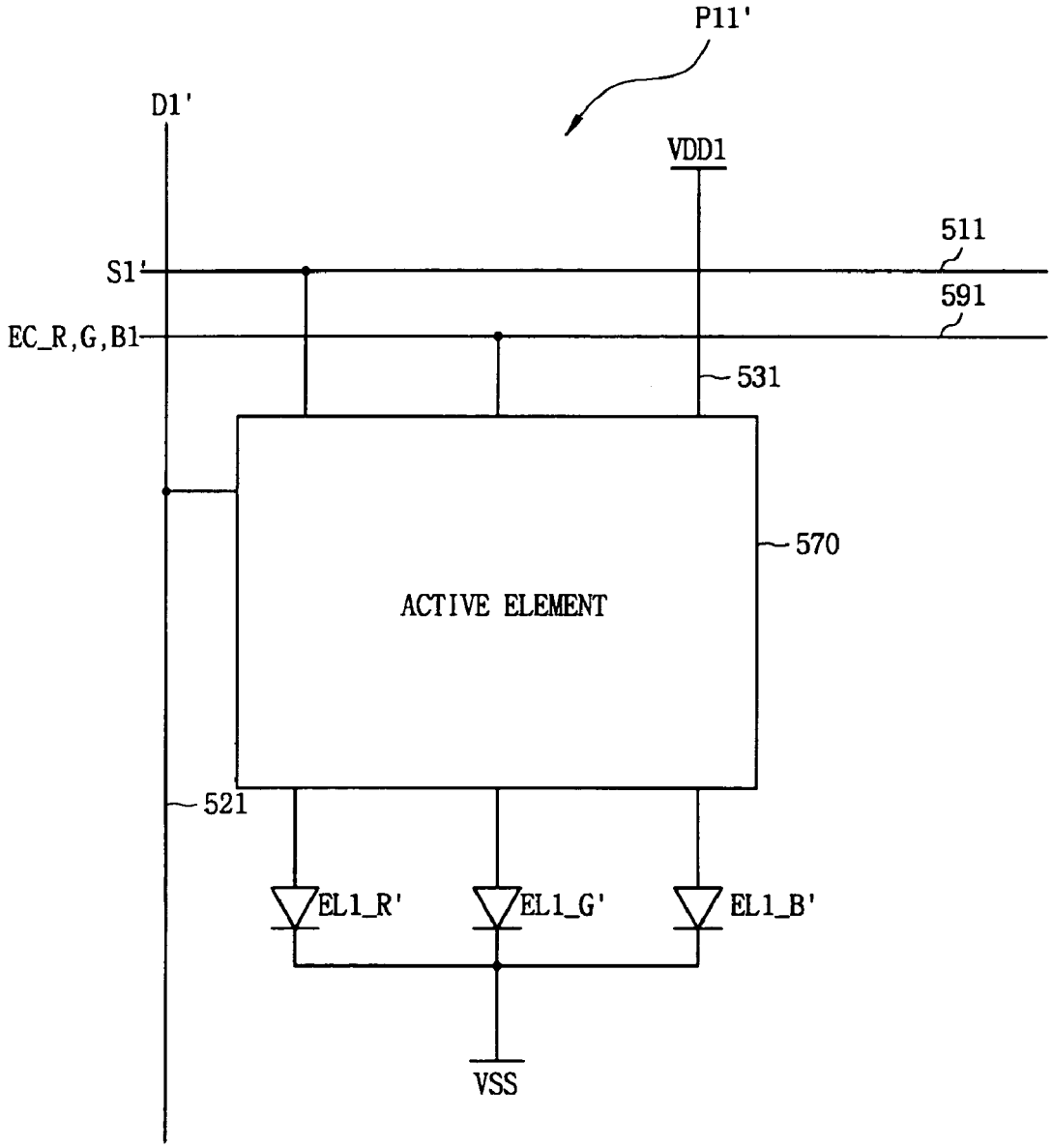
FIG. 6 is a drawing schematically illustrating a pixel circuit of an organic electroluminescent display device according to the first exemplary embodiment of the present invention.

FIG. 6 schematically illustrates a pixel circuit for one pixel in a time-divisionally driving type organic electroluminescent display device according to the first exemplary embodiment of the present invention. FIG. 6 illustrates one pixel P11' in a plurality of pixels.

Referring to FIG. 6, the pixel includes an active element 570 connected to the first gate line 511, the first data line 521, the first emission control line 591 and the first common power supply line 531, and red, green and blue EL devices EL1_R', EL1_G', EL1_B' connected in parallel between the active element 570 and a common voltage (e.g., ground) VSS. First electrodes, e.g., anode electrodes, are connected to the active element 570, and second electrodes, e.g., cathode electrodes, are commonly connected to the common voltage VSS, in the red, green and blue EL devices EL1_R', EL1_G', EL1_B'.

The red, green and blue EL devices EL1_R', EL1_G', EL1_B' should be time-divisionally driven so that a pixel P11' displays a certain color by driving the three red, green and blue EL devices EL1_R', EL1_G', EL1_B' during one frame since the red, green and blue EL devices EL1_R', EL1_G', EL1_B' share one active element 570 in a pixel circuit having the structure of FIG. 6. That is, the red, green and blue EL devices EL1_R', EL1_G', EL1_B' are time-divisionally driven during one frame so that the pixel P11' realizes a certain color by dividing one frame into three sub frames and driving one of the red, green and blue EL devices EL1_R', EL1_G', EL1_B' during each sub frame.

In other words, the active element 570 drives the red EL device EL1_R' using the emission control signal EC_R1 generated to the emission control line 591 from the emission control signal generating circuit 590 so that red color corresponding to red data is emitted if red data DR1' is applied as a data D1' applied to the data line 521 as the scan signal S1' is applied from the gate line 511 to the active element 570 in the first sub frame of one frame. Similarly, when the scan signal S1' is applied from the gate line 511 to the active element 570 in the second sub frame, green data DG1' is applied as the data D1' applied to the data line 521, and the green EL device EL1_G' is emitted by the emission control signal EC_G1 generated to the emission control line 591 from the emission control signal generating circuit 590 so that green color corresponding to the green data is emitted. Finally, when the scan signal S1' is applied from the gate line 511 to the active element 570 in the third sub frame, blue data DB1'is applied as the data D1' applied to the data line 521, and the blue EL device EL1_B' is emitted by the emission control signal EC_B1 generated to the emission control line 591 from the emission control signal generating circuit 590 so that blue color corresponding to the blue data is emitted. Therefore, red, green and blue EL devices are sequentially driven time-divisionally during one frame so that each pixel emits a certain color to display an image.

Although red, green and blue colors are emitted to realize a certain color by driving the EL devices in the order of red, green and blue EL devices during the three sub frames of one frame in the first exemplary embodiment of the present invention, emission sequence of red, green and blue EL devices or red, green, blue and white EL devices may be temporarily or permanently changed, and/or one frame may be divided into more than three sub frames so that at least one color out of red, green and blue colors is further emitted in the remaining sub frame(s) in order to adjust chromaticity, brightness or luminance.

For example, one color of red, green, blue or white can be further emitted during an additional one sub frames such as RRGB, RGGB, RGBB and RGBW by dividing one frame into four sub frames, and the additional emitted color is emitted from an appropriate sub frame in a plurality of sub frames, wherein one EL device in the red, green, blue and white EL devices is driven, or at least two EL devices in the red, green, blue and white EL devices are driven so that one color of red, green, blue or white is further emitted during the additional one or more sub frames.

Further, although the first exemplary embodiment of the present invention discloses that red, green and blue EL devices are sequentially driven during one frame of three sub frames, the plurality of sub frames are sequentially driven time-divisionally by dividing red, green, blue or white into a plurality of sub frames during one frame, or the plurality of sub frames are sequentially driven time-divisionally by dividing at least two colors in the red, green, blue and white into a plurality of sub frames during one frame.

Figure 7A:
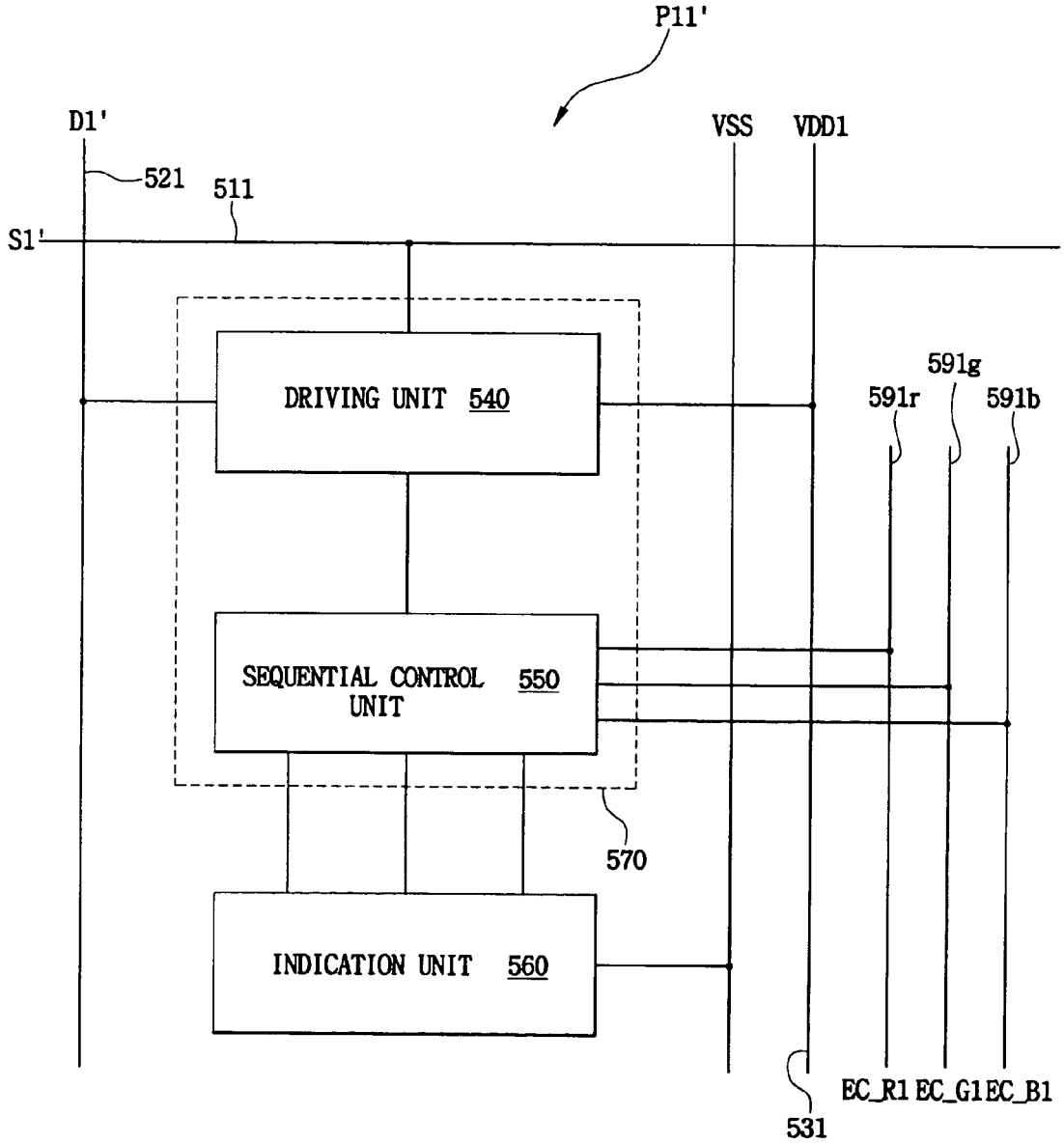
FIG. 7A is a block structural view of a pixel circuit of the pixel part of FIG. 5A.
Figure 8A:
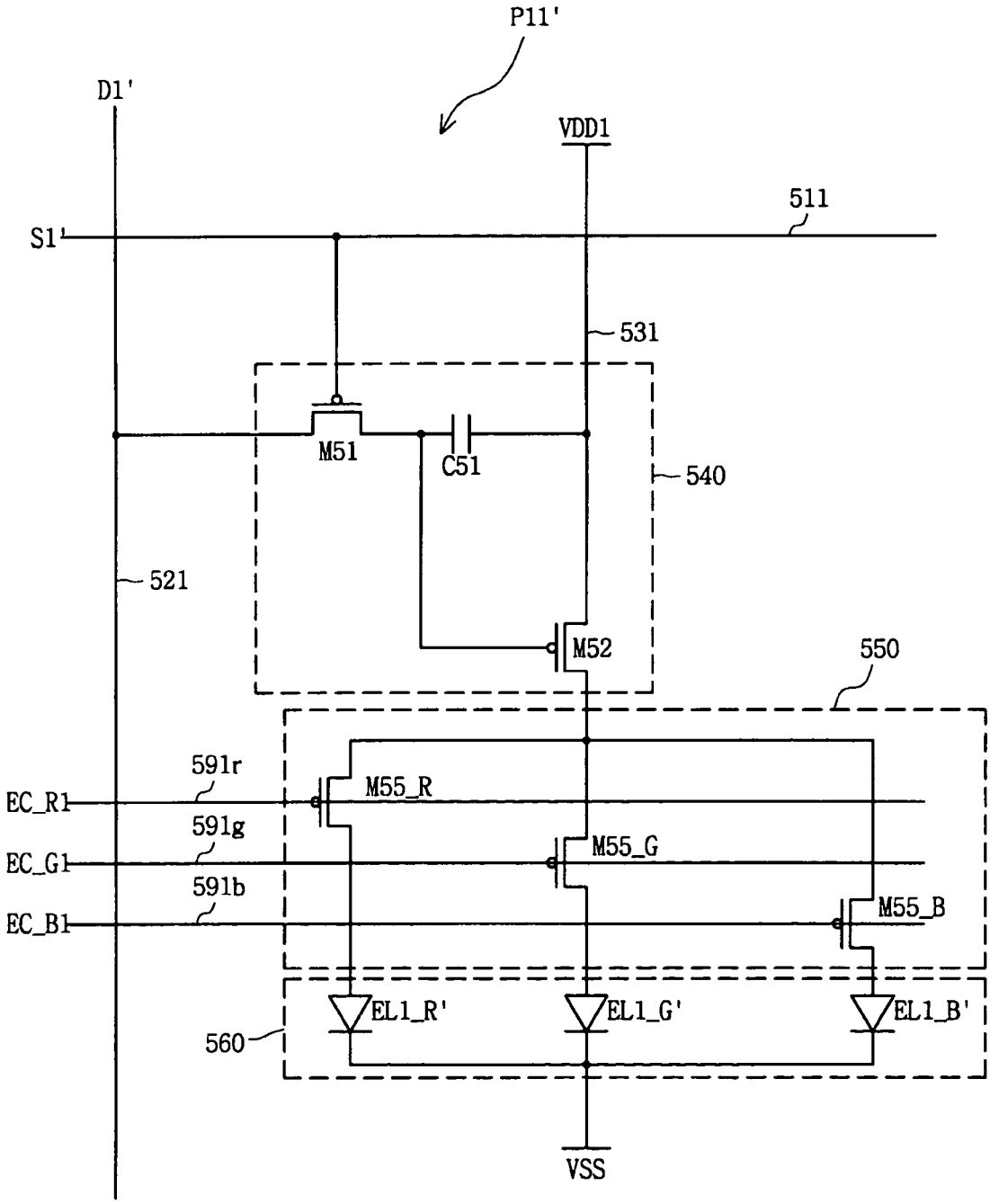
FIG. 8A is a detailed circuit diagram of the pixel circuit of FIG. 7A.

FIG. 7A illustrates a block structural view of a pixel circuit of time-divisional driving type organic electroluminescent display device according to one exemplary embodiment of the present invention, and FIG. 8A illustrates one example of detailed circuit diagram of the pixel circuit of FIG. 7A. Pixel circuits of FIG. 7A and FIG. 8A illustrate examples of pixel circuit for sequentially driving red, green and blue EL devices EL1_R', EL1_G', EL1_B' time-divisionally during one frame.

Referring to FIG. 7A and FIG. 8A, the pixel P11' includes one gate line 511, one data line 521, three emission control lines 591*r*, 591*g*, 591*b*, the power supply line 531, and an indication unit 560 time-divisionally driven by signals applied through the lines. The indication unit 560 includes a light emitting element for self-emitting light. The light emitting element includes red, green and blue EL devices EL1_R', EL1_G', EL1_B' for emitting red, green and blue respectively.

Further, the pixel P11' includes the active element 570 for sequentially driving the red, green and blue EL devices EL1_R', EL1_G', EL1_B' time-divisionally. The active element 570 includes a driving unit 540 for supplying driving current corresponding to red, green and blue data signals DR1', DG1', DB1' to the EL devices EL1_R', EL1_G', EL1_B' of the indication unit 560 whenever the scan signal S1' is applied, and a sequential control unit 550 for controlling the driving current corresponding to the red, green and blue data signals DR1', DG1', DB1'. The data signals are sequentially supplied to the red, green and blue EL devices EL1_R', EL1_G', EL1_B' from the driving unit 540 according to the emission control signals $EC_R_1$, $EC_G_1$, EC_B1.

As shown in FIG. 8A, the driving unit 540 includes a switching transistor M51 in which the scan signal S1' is supplied to gate from the gate line 511, and red, green and blue data signals DR1', DG1', DB1' are time-divisionally supplied to a source from the data line 521. The driving unit 540 also includes a driving transistor M52 having a gate connected to a drain of the switching transistor M51. A power supply voltage VDD1 is supplied to a source from the power supply voltage line 531, and a drain is connected to the sequential control unit 550. A capacitor C51 is connected between a gate and a source of the driving transistor M52.

Although the driving unit 540 includes two thin film transistors of switching transistor and driving transistor and one capacitor in the described embodiment of the present invention, any suitable structure capable of driving light emitting element including the indication unit 560 may be used. Further, the driving unit 540 of FIG. 7A may also include any device capable of improving driving characteristics for driving the light emitting element of the indication unit 560, e.g., a threshold compensation device. Although all thin film transistors in the driving unit 540 are P type thin film transistors, the thin film transistors can be N type thin film transistors or any combination of N type thin film transistors and P type thin film transistors. In addition, N type or P type thin film transistors of depletion mode and/or enhancement mode may be used. Further, the driving unit 540 may be constructed using various types of switching elements such as thin film diode, diode, TRS (triodic rectifier switch), etc. instead of or in addition to the thin film transistors.

The sequential control unit 550 is connected between the driving unit 540 and the indication unit 560 to time-divisionally and sequentially drive red, green and blue EL devices EL1_R', EL1_G', EL1_B' of the indication unit 560 according to red, green and blue emission control signals $EC_R_1$, $EC_G_1$, EC_B1 supplied through emission control lines 591*r*, 591*g*, 591*b* from the emission control signal generating circuit 590.

The sequential control unit 550 includes first, second and third control devices connected between the drain of the driving transistor M52 and anodes of the red, green and blue EL devices EL1_R', EL1_G', EL1_B', respectively, to sequentially control time-divisional driving of the red, green and blue EL devices EL1_R', EL1_G', EL1_B' according to the emission control signals EC_R1, EC_G1 EC_B1.

The first control device includes a thin film transistor M55_R on which the first emission control signal EC_R1 is applied to a gate, a source is connected to the drain of the driving transistor M52, and a drain is connected to the anode of the red EL device EL1_R' to drive the red EL device EL1_R' correspondingly to a red data signal applied through the driving transistor M52 by the first emission control signal EC_R1.

The second control device includes a thin film transistor M55_G to which the second emission control signal EC~G1 is applied to a gate, a source is connected to the drain of driving transistor M52, and a drain is connected to the anode of the green EL device EL1_G' to drive the green EL device EL1_G' correspondingly to a green data signal applied through the driving transistor M52 by the second emission control signal EC_G1.

The third control device includes a thin film transistor M55_B to which the third emission control signal EC_B1 is applied to a gate, a source is connected to the drain of the driving transistor M52, and a drain is connected to the anode of the blue EL device EL1_B' to drive the blue EL device EL1_B' correspondingly to a blue data signal applied through the driving transistor M52 by the third emission control signal EC_B1.

Although the sequential control unit 550 includes P type thin film transistors in the described embodiment, the sequential control unit 550 can be formed of N type thin film transistors or any suitable combination of N type thin film transistors and P type thin film transistors. N type and/or P type thin film transistors of depletion mode or enhancement mode may be used. Further, the sequential control unit 550 can be constructed by using various types of switching elements such as a thin film diode, a diode, a TRS, etc., instead of or in addition to the thin film transistors. The sequential control unit 550 can be constructed as any suitable device capable of sequentially driving the red, green and blue EL devices.

Although in the described exemplary embodiment of the present invention, a structure in which red, green and blue light emitting elements are time-divisionally driven by one active element is described in reference to the red, green and blue EL devices, the structure can also be applied to other light emitting display devices such as FED (field emission display) and PDP (plasma display panel).

The process of time-divisionally driving a pixel circuit of an organic electroluminescent display device in exemplary embodiments of the present invention is described as follows.

Figure 3:
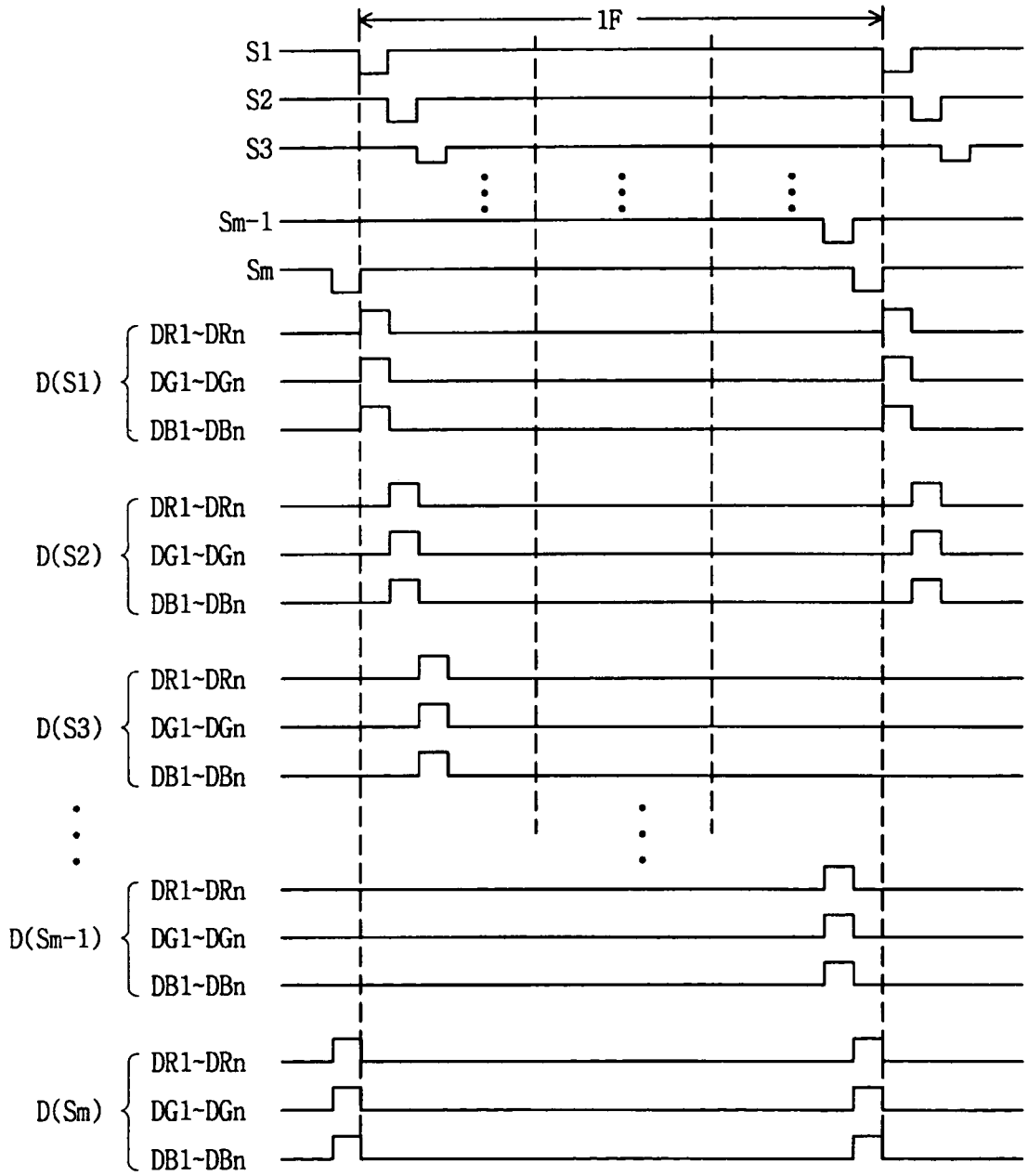
FIG. 3 is a waveform diagram of operation of the organic electroluminescent display device of FIG. 1.

Conventionally, each one of scan signals S1~Sm is sequentially applied to a plurality of gate lines from the gate line driving circuit 110 so that m scan signals are applied during one frame, and red, green and blue data signals DR1~DRn, DG1~DGn, DB1~DBn are simultaneously applied to red, green and blue data lines from the data line driving circuit 120 whenever the respective scan signals S1~Sm are applied so that pixels are driven as illustrated in FIG. 3.

In the described exemplary embodiment of the present invention, however, one frame is divided into three sub frames, scan signals are respectively applied to gate lines from gate line driving circuit 510 during each sub frame so that 3*m* scan signals are applied during one frame. In case of the first pixel, when the scan signal S1' is applied to the first gate line 511 during the first sub frame, the switching transistor M51 is turned on so that the red data signal DR1' is supplied to the driving transistor M52 from the data line 521, wherein the sequential control unit 550 drives the red EL device EL1_R' correspondingly to the red data signal DR1' as the thin film transistor M55_R (i.e., the first control device) is turned on by the first emission control signal EC_R1.

Next, the sequential control unit 550 drives the green EL device EL1_G' correspondingly to the green data signal DG1' as the scan signal S1' is applied to the first gate line 511 during the second sub frame so that the green data signal DG1' is supplied to the driving transistor M52 from the data line 521, and the thin film transistor M55_G (i.e., the second control device) is turned on by the second emission control signal EC_G1.

Finally, the sequential control unit 550 drives the blue EL device EL1_B' correspondingly to the blue data signal DB1' as the scan signal S1' is applied to the first gate line 511 during the third sub frame so that the blue data signal DB1' is supplied to the driving transistor M52 from the data line 521, and the thin film transistor M55_B (i.e., the third control device) is turned on by the third emission control signal EC_B1.

In this manner, the red data signals DR1'~DRn', the green data signals DG1'~DGn' and the blue data signals DB1'~DBn' are sequentially applied to the data lines so that red, green and blue EL devices EL_R', EL_G', EL_B' of pixels P11'~Pmn' are sequentially driven time-divisionally whenever the scan signals S1'~Sm' are applied during the respective sub frames during one frame.

Therefore, circuit structure can be simplified in a pixel circuit of the present invention as the red, green and blue EL devices EL_R', EL_G', EL_B' of the pixel P11' share an active element 570 so that each pixel requires one gate line, one data line, three emission control lines and one power supply line only.

Figure 5B:
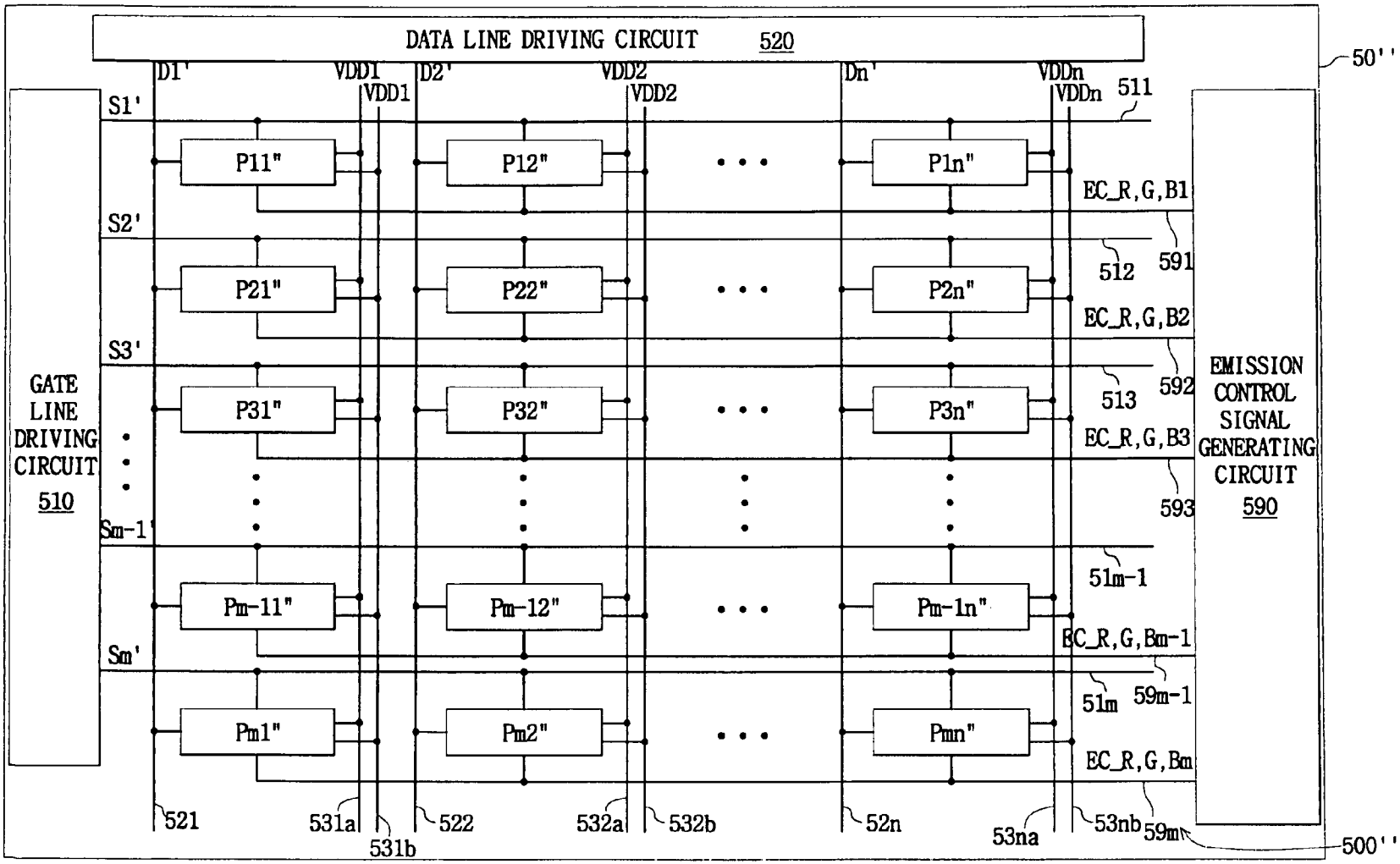
FIG. 5B illustrates a block structural view of another pixel part applicable to the organic electroluminescent display device of FIG. 4.
Figure 7B:
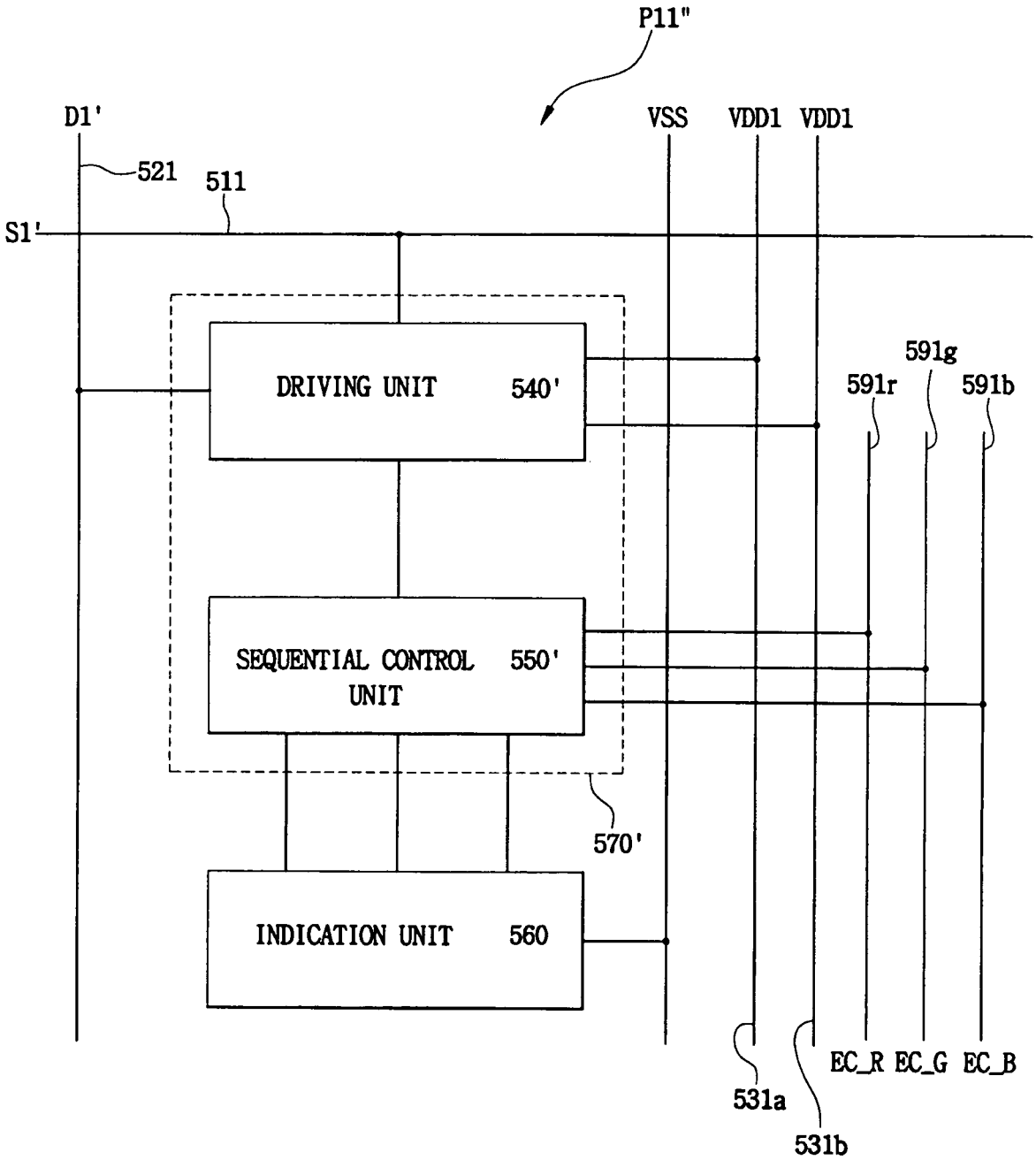
FIG. 7B is a block structural view of a pixel circuit of the pixel part of FIG. 5B.

FIG. 5B illustrates another block structure of a pixel part 500" in an organic electroluminescent display device 50" according to the first exemplary embodiment of the present invention. FIG. 7B illustrates another block structural view of a pixel circuit P11" of a time-divisional driving type organic electroluminescent display device of the present invention illustrated in FIG. 5B, and FIG. 8B illustrates a detailed circuit diagram of the pixel circuit P11" of FIG. 7B.

Figure 8B:
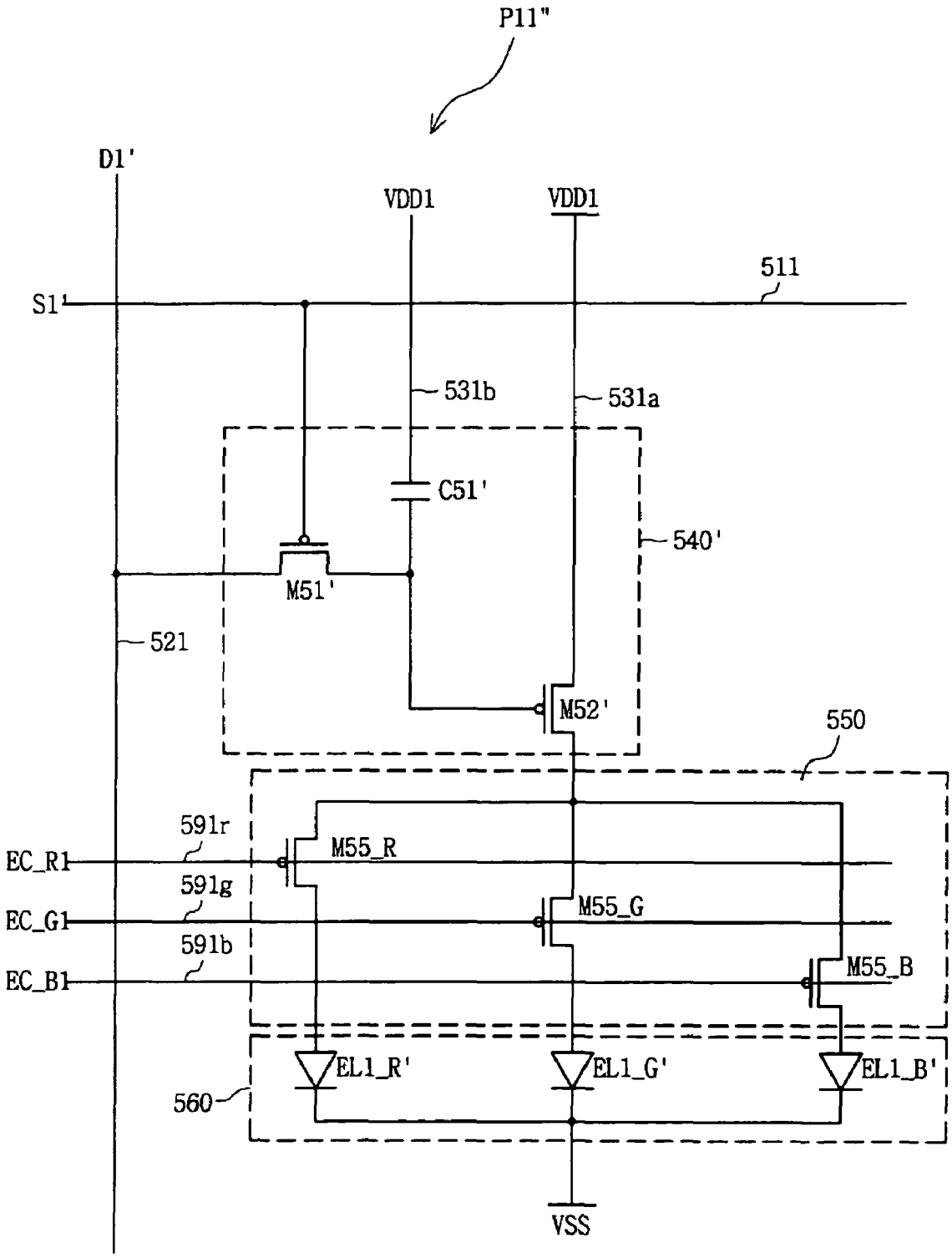
FIG. 8B is a detailed circuit diagram of the pixel circuit of FIG. 7B.

The pixel circuit P11" illustrated in FIG. 5B, FIG. 7B and FIG. 8B is substantially the same as the pixel circuit P11' of FIG. 5A, FIG. 7A and FIG. 8A except that a separate power supply line is installed so that a power supply voltage VDD1 is supplied to a capacitor C51' of a driving unit 540' in an active element 570', through a power supply line 531*b*, and the power supply voltage VDD1 is supplied to a source of a driving transistor M52' through a power supply line 531*a*. This is different from the pixel circuit P11' wherein the same power supply voltage VDD1 is supplied to the capacitor C51 of a driving unit 540 and the source of the driving transistor M52 through the same power supply line 531. Hence, in the pixel circuit P11", data signals are stored in the capacitor C51' more stably by separating power supply line supplied to the capacitor C51' from the power supply line supplied to the driving transistor M52'. In the pixel circuit P11", a driving transistor M51' is coupled in substantially the same manner as the driving transistor M51 is in the pixel circuit P11'.

Figure 9:
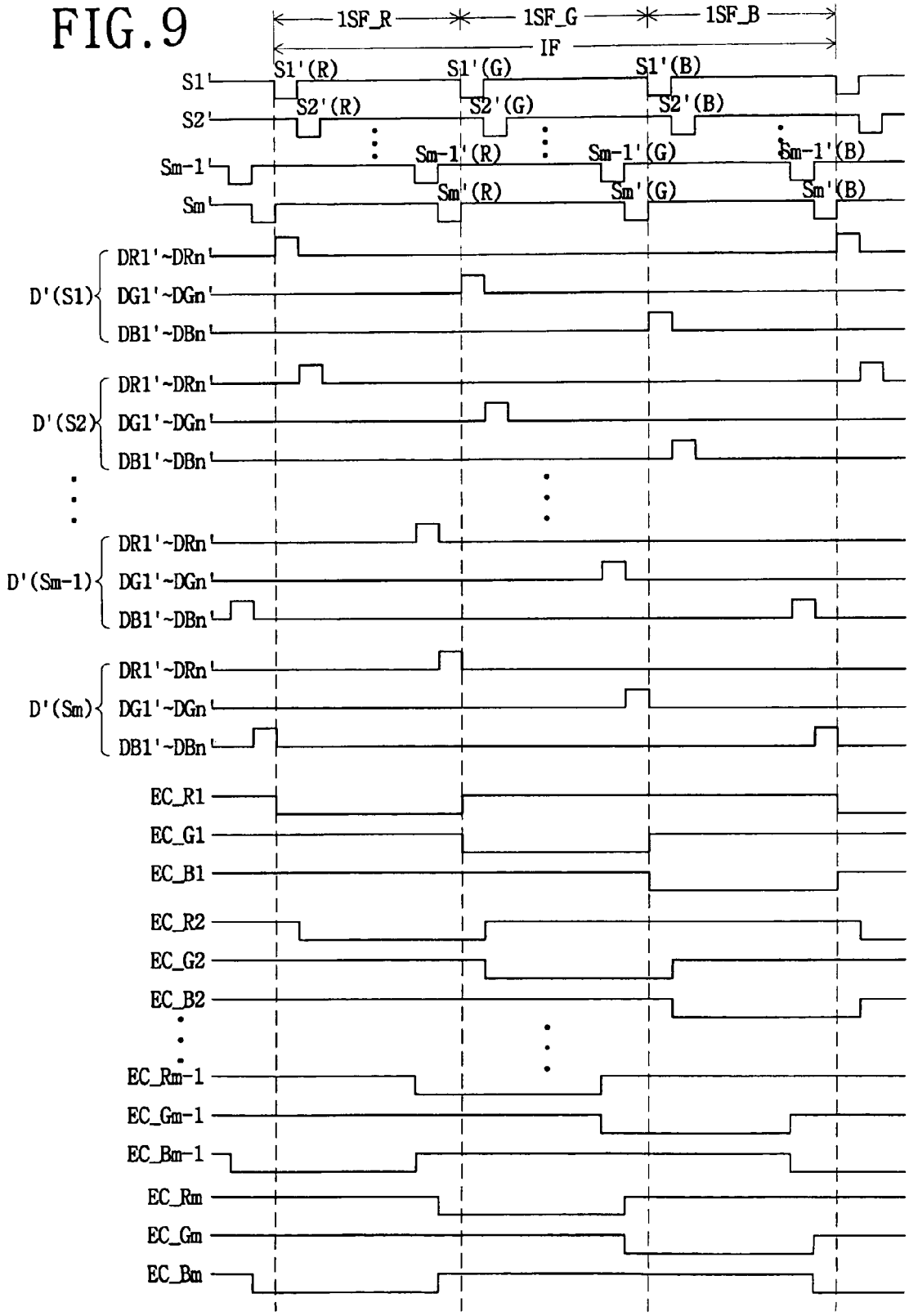
FIG. 9 is a driving waveform diagram of a pixel circuit of an organic electroluminescent display device according to the first exemplary embodiment of the present invention.

A method for time-divisionally and sequentially driving an organic electroluminescent display device according to the first exemplary embodiment of the present invention as described above is described in detail as follows in reference to the driving waveform diagram of FIG. 9. The description will be made in reference to the illustrated embodiment of FIGS. 5A, 7A and 8A with the understanding that the description applies equally as well to the illustrated embodiment of FIGS. 5B, 7B and 8B.

First, when a scan signal S1'(R) is applied to the first gate line 511 from the gate line driving circuit 510 during a first sub frame 1SF_R in one frame, the first gate line 511 is driven, and red data signals DR1'~DRn' are supplied as data signals D1'~Dn' to the driving transistor of the pixels P11'~P1*n*' connected to the first gate line 511 from the data line driving circuit 520'.

When the emission control signal EC_R1 from the emission control signal generating circuit 590 for controlling the red EL device EL_R' of the pixels P11'~P1*n*' connected to the first gate line is applied to the sequential control unit 550 through the emission control line 591*r*, the thin film transistor M55_R is turned on, and driving current corresponding to the red data signals DR1'~DRn' is supplied to the red EL device so that the red EL device is driven.

Subsequently, when a second scan signal S1'(G) is applied to the first gate line 511 during a second sub frame 1SF_G of the first frame 1F, green data signals DG1'~DGn' are supplied to the driving transistor M52 through the data lines 521~52*n*. When the emission control signal EC_G1 from the emission control signal generating circuit 590 for controlling the green EL device EL_G' of the pixels P11'~P1*n*' connected to the first gate line 511 is applied to the sequential control unit 550 through the emission control line 591*g*, the thin film transistor M55_G is turned on, and driving current corresponding to the green data signals DG1'~DGn' is supplied to the green EL device so that the green EL device is driven.

Finally, when a third scan signal S1'(B) is applied to the first gate line 511 during a third sub frame 1SF_B of the first frame 1F, blue data signals DB1'~DBn' are supplied to the driving transistor M52 through the data lines 521~52*n*. When the emission control signal EC_B1 from the emission control signal generating circuit 590 for controlling the blue EL device EL_B' of the pixels P11'~P1*n*' connected to the first gate line 511 is applied to the sequential control unit 550 through the emission control line 591*b*, the thin film transistor M55_B is turned on, and driving current corresponding to the blue data signals DB1'~DBn' is supplied to the blue EL device so that the blue EL device is driven.

Subsequently, when a scan signal S2' is applied to the second gate line 512 per each sub frame of one frame, red, green and blue data signals DR1'~DRn', DG1'~DGn', DB1'~DBn' are sequentially applied to the data lines 521~52*n*. Further, emission control signals EC_R2, EC_G2, EC_B2 from the emission control signal generating circuit 590 for sequentially controlling the red, green and blue EL devices of the pixels P21'-P2*n*' connected to the second gate line 512 are sequentially applied to the sequential control unit 550 through the emission control lines 591*r*, 591*g*, 591*b*, respectively, as described above. Therefore, the thin film transistors M55_R, M55_G, M55_B are sequentially turned on, and driving currents corresponding to the red, green and blue data signals DR1'~DRn', DG1'~DGn', DB1'~DBn' are sequentially supplied to the red, green and blue EL devices so that the red, green and blue EL devices are time-divisionally driven.

The red, green and blue data signals DR1'~DRn', DG1'~DGn', DB1'~DBn' are sequentially applied to the data lines 521-52*n*, and emission control signals EC_Rm, EC_Gm, EC_Bm from the emission control signal generating circuit 590 for sequentially controlling the red, green and blue EL devices of the pixels Pm1'~Pmn' connected to the $m^{th}$ gate line 51*m* are sequentially applied to the sequential control unit 550 through the emission control lines 591*a*, 591*b*, 591*c*, respectively, when the scan signal is applied to the $m^{th}$ gate line 51*m* per each sub frame of one frame by repeating the above described actions. Accordingly, the thin film transistors M55_R, M55_G, M55_B are sequentially turned on, and driving currents corresponding to the red, green and blue data signals DR1'~DRn', DG1'~DGn', DB1'~DBn' are sequentially supplied to the red, green and blue EL devices so that the red, green and blue EL devices are time-divisionally driven.

Therefore, one frame is divided into three sub frames in the described exemplary embodiment, and an image is displayed by time-divisionally sequentially driving red, green and blue EL devices during the three sub frames. The image displayed using time-divisional driving of the EL devices is perceived by people as simultaneous driving of the EL devices since sequential driving time of the red, green and blue EL devices is very fast although the red, green and blue EL devices are time-divisionally driven.

Further, an organic electroluminescent display device according to the first exemplary embodiment of the present invention is capable of controlling white balance by controlling emission time of the red, green and blue EL devices, wherein the organic electroluminescent display device is capable of controlling white balance by controlling turn on times of the thin film transistors M55_R, M55_G, M55_B of the sequential control unit 550 of FIG. 8A and FIG. 8B, thereby controlling emission time of the red, green and blue EL devices.

Figure 10:
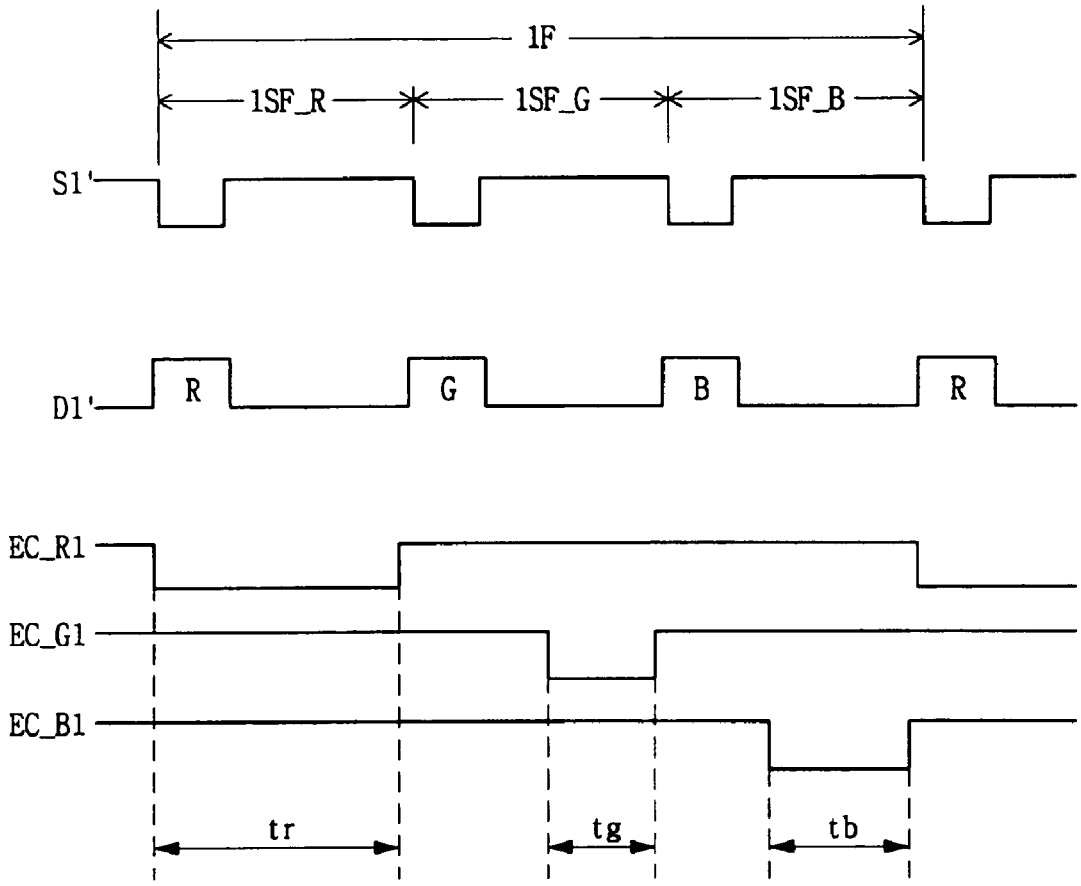
FIG. 10 is a driving waveform diagram illustrating white balance control in an organic electroluminescent display device according to the first exemplary embodiment of the present invention.

In more detail, turn on times tr, tg, tb of the red, green and blue emission control signals $EC_R_1$, $EC_G_1$, EC_B1 generated from the emission control signal generating circuit 590 are controlled per each sub frame as illustrated in FIG. 10, and times for turning on the thin film transistors M55_R, M55_G, M55_B of the sequential control unit 550 are determined accordingly. Therefore, white balance is controlled by controlling emission times of the red, green and blue EL devices.

Although it is illustrated in FIG. 10 that white balance is achieved by relatively lengthening the turn on time tr of the red emission control signal EC_R1 as compared to the turn on times tg, tb of the green and blue emission control signals $EC_G_1$, EC_B1, and shortening the turn on time tg of the green emission control signal EC_G1 as compared to the turn on time tb of the blue emission control signal EC_B, the present invention is not restricted to this. In fact, it is possible to control white balance by adjusting the turn on times of the red, green and blue emission control signals $EC_R_1$, $EC_G_1$, EC_B1 in various different combinations. Of course, the white balance control scheme of FIG. 10 is broadly applicable to all of the red, green and blue control signals EC_R, EC_G and EC_B for all of the pixels rather than being limited to $EC_R_1$, EC_G1 and EC_B1.

As described above, in exemplary embodiments of the present invention, not only white balance is controlled by controlling red, green and blue emission times, but also the red, green and blue emission times may further be controlled to optimize brightness in the state that the red, green and blue emission times are primarily controlled so that white balance is controlled.

Figure 11:
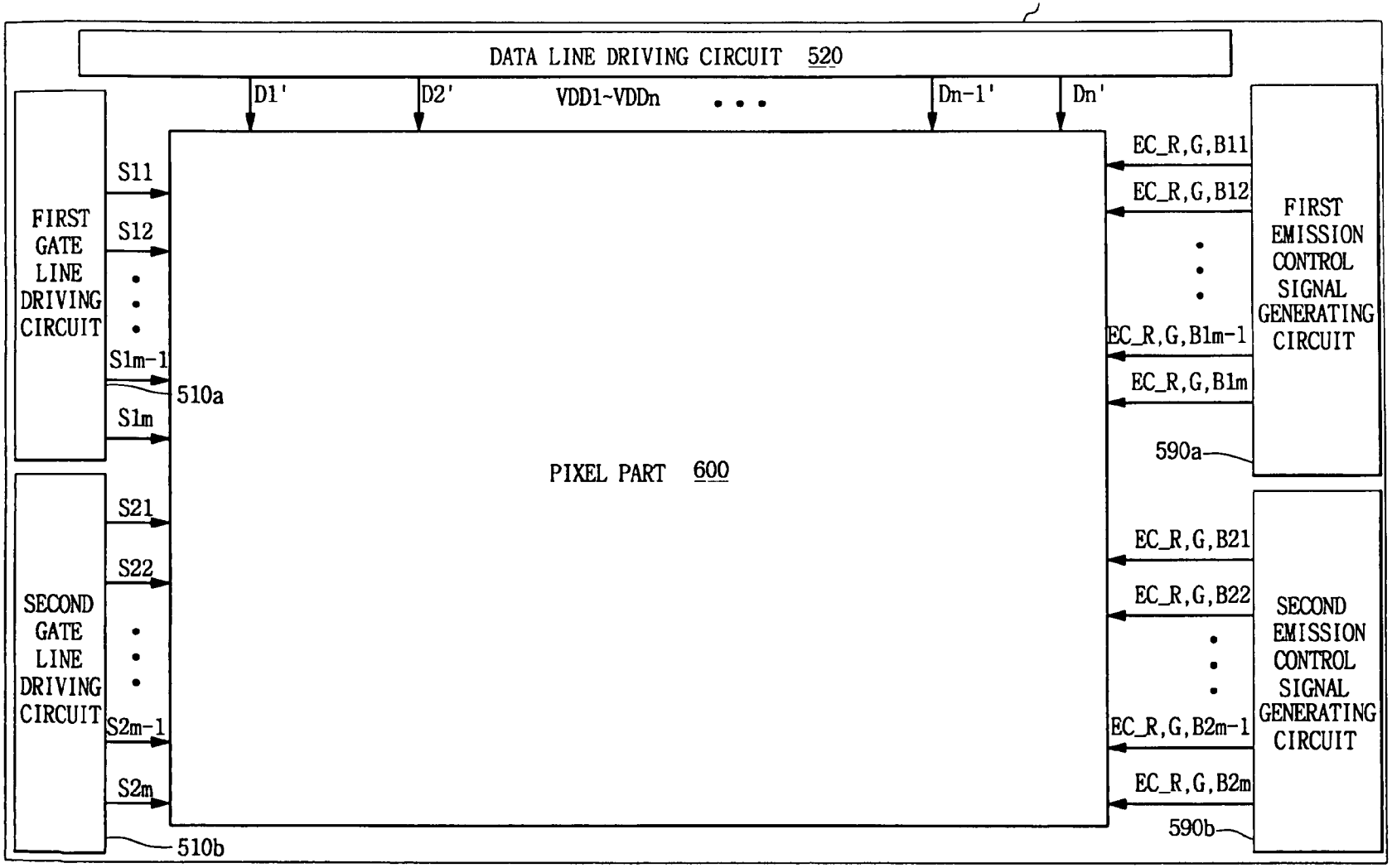
FIG. 11 is a block structural view of an organic electroluminescent display device according to a second exemplary embodiment of the present invention.

FIG. 11 illustrates a block structural view of an organic electroluminescent display device 60 having a pixel part 600, according to a second exemplary embodiment of the present invention. An organic electroluminescent display device of FIG. 11 has the similar structure and operation as the organic electroluminescent display device 50 of FIG. 4 except that two gate line driving circuits 510*a*, 510*b* and two emission control signal generating circuits 590*a*, 590*b* are arranged.

That is, it is constructed in such a way that scan signals are supplied to some of the gate lines from a first gate line driving circuit 510*a*, and scan signals are supplied to the rest of the gate lines from a second gate line driving circuit 510*b*, wherein the scan signals are applied to the upper part of the gate lines from the first gate line driving circuit 510*a*, and the scan signals are sequentially applied to the lower part of the gate lines from the second gate line driving circuit 510*b*. In further embodiments, the scan signals may be applied to even numbered gate lines from a first gate line driving circuit, and scan signals may be applied to odd numbered gate lines from a second gate line driving circuit so as to reduce density of the gate lines arranged in the pixel part. In such cases, each of the first and second gate line driving circuits 510*a*, 510*b* may have circuitry for generating only half the scan signals so as to save cost and space.

In the organic electroluminescent display device 60, scan signals may be substantially simultaneously supplied to the gate lines from the driving circuits 510*a*, 510*b* to reduce signal delay and/or to supply redundancy. To provide such signal delay reduction or redundancy capabilities, the first and second gate line driving circuits 510*a*, 510*b* may generate scan signals S11~S1*m* and scan signals S21~S2*m*, respectively, corresponding to all of the scan lines.

In the organic electroluminescent display device 60, emission control signals are supplied to some of the emission control lines from a first emission control signal generating circuit 590*a*, and emission control signals are supplied to the rest of the emission control lines from a second emission control signal generating circuit 590*b*, wherein the emission control signals are applied to the upper part of the emission control signal lines from the first emission control signal generating circuit 590*a*, and the emission control signals are sequentially applied to the lower part of the emission control signal lines from the second emission control signal generating circuit 590*b*. In further embodiments, the emission control signals may be applied to even numbered emission control lines from a first emission control signal generating circuit, and the emission control signals may be applied to odd numbered emission control lines from a second emission control signal generating circuit, so as to reduce density of emission control lines arranged in the pixel part. In such cases, each of the first and second emission control line generating circuits 590*a*, 590*b* may have circuitry for generating only half the emission control signals so as to save cost and space.

In the organic electroluminescent display device 60, emission control signals may be substantially simultaneously supplied to the emission control lines from the first and second emission control signal generating circuits 590*a*, 590*b* to reduce signal delay and/or to supply redundancy. To provide such signal delay reduction or redundancy capabilities, the first and second emission control generating circuits 590*a*, 590*b* may generate emission control signals EC_R,G, B11~EC_R,G,B1*m* and emission control signals EC_R,G, B21~EC_R,G,B2*m*, respectively, corresponding to all of the emission control lines.

Figure 12:
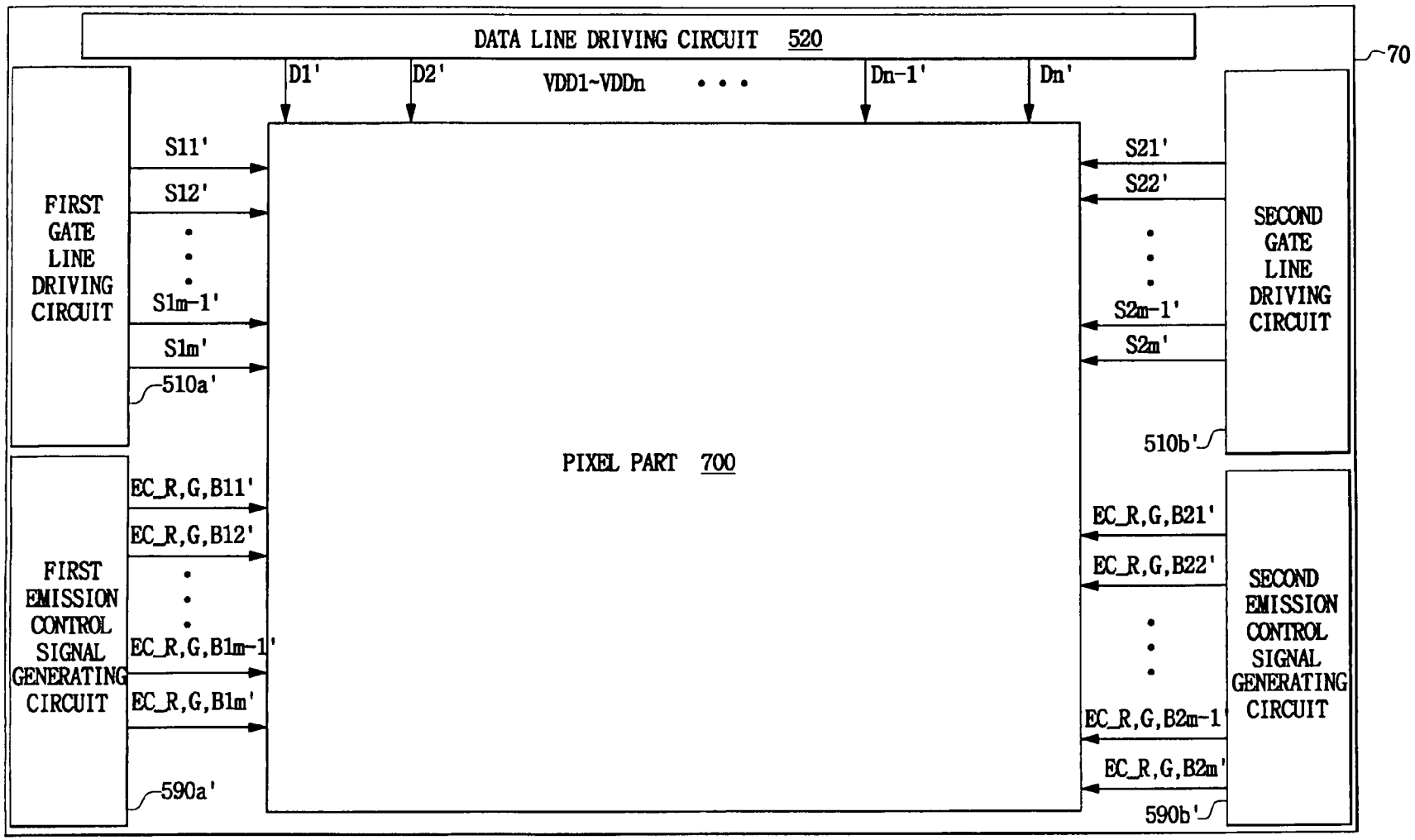
FIG. 12 is a block structural view of an organic electroluminescent display device according to a third exemplary embodiment of the present invention.

FIG. 12 illustrates a block structural view of an organic electroluminescent display device 70 having a pixel part 700 according to a third exemplary embodiment of the present invention. The organic electroluminescent display device 70 of FIG. 12 has the similar structure and operation as the organic electroluminescent display device 60 of FIG. 11 except that arrangement positions of two gate line driving circuits 510*a*', 510*b*' and two emission control signal generating circuits 590*a*', 590*b*' are different from the corresponding circuits of FIG. 11. The first gate line driving circuit 510*a*' may generate scan signals S11'~S1*m*', and the second gate line driving circuit 510*b*' may generate scan signals S21'~S2*m*'. In other embodiments, the first and second gate line driving circuits 510*a*', 510*b*' may each generate only half of the scan signals so as to save cost and space.

The first emission control signal generating circuit 590*a*' may generate emission control signals EC_R, G, B11'~EC_R, G, B1*m*', and the second emission control signal generating circuit 590*b*' may generate emission control signals EC_R, G. B21'~EC_R, G. B2*m*'. In other embodiments, the first and second emission control signal generating circuits may each generate only half of the emission control signals so as to save cost and space.

While it is shown in certain exemplary embodiments of the present invention that a plurality of gate line driving circuits and emission control signal generating circuits can be used in an organic electroluminescent display device, a plurality of data line driving circuits may also be used in other embodiments.

An organic electroluminescent display device according to the above described exemplary embodiments of the present invention enables high accuracy fineness by having a driving thin film transistor and a switching thin film transistor shared by red, green and blue EL devices so that the red, green and blue EL devices are time sharingly driven and improves opening ratio and yield by decreasing the number of elements and wirings. An organic electroluminescent display device according to the present invention also results in the reduction of RC delay and voltage drop (IR drop).

Further, an organic electroluminescent display device according to the present invention also enables controlling of white balance and brightness by controlling emission time of the red, green and blue EL devices.

While the invention has been shown and described with reference to certain exemplary embodiments thereof, it will be understood by those skilled in the art that the foregoing and other changes in form and details may be made therein without departing from the spirit and scope of the invention. The scope of the present invention is indicated by the appended claims, and all changes that come within the meaning and range of equivalents thereof are intended to be embraced therein.

What is claimed is:

1. A pixel circuit of a display device for realizing a certain color during a display period of time comprising:

at least two light emitting elements between a first constant voltage source and a second constant voltage source, each said light emitting element for emitting a corresponding one of colors during the display period of time; and an active element commonly connected to the at least two light emitting elements to drive the at least two light emitting elements, the active element comprising a driving transistor coupled between the first constant voltage source and the at least two light emitting elements, wherein the active element time-divisionally drives the at least two light emitting elements during the display period of time, such that one said light emitting element emits the corresponding one of the colors per a sub display period of time, and wherein the at least two light emitting elements realize the certain color in the display period of time by time-divisionally emitting the corresponding ones of the colors.

2. The pixel circuit of a display device according to claim 1, wherein the display period of time is one frame, the sub display period of time is a sub frame, the one frame is divided into at least two sub frames, and the at least two light emitting elements are time-divisionally driven in accordance with the sub frames inside the one frame.

3. The pixel circuit of a display device according to claim 1, wherein the display period of time is one frame, the sub display period of time is a sub frame, the one frame is divided into at least three sub frames, the at least two light emitting elements are time-divisionally driven in accordance with at least two of the sub frames inside the one frame, and one of the at least two light emitting elements is driven again or the at least two light emitting elements are simultaneously driven in a remaining at least one of the sub frames.

4. The pixel circuit of a display device according to claim 3, wherein the remaining at least one of the sub frames is arbitrarily selected from the sub frames.

5. The pixel circuit of a display device according to claim 1, wherein a light emitting time of the at least two light emitting elements is controlled to control white balance.

6. The pixel circuit of a display device according to claim 1, wherein the display device is an FED (field emission display) or a PDP (plasma display panel).

7. The pixel circuit of a display device according to claim 1, wherein the at least two light emitting elements include a red, green, blue or white EL device.

8. The pixel circuit of a display device according to claim 7, the EL device having a first electrode and a second electrode, wherein the first electrode is connected to the active element, and the second electrode is connected to the second constant voltage source.

9. The pixel circuit of a display device according to claim 7, wherein the EL device is arranged in stripe type, delta type or mosaic type.

10. The pixel circuit of a display device according to claim 1, wherein the driving transistor is for driving the at least two light emitting elements.

11. A pixel circuit of a display device comprising:

red, green and blue EL devices coupled between a first constant voltage source and a second constant voltage source;

at least one switching transistor for time-divisionally transmitting red, green and blue data signals;

at least one driving transistor for time-divisionally driving the red, green and blue EL devices according to the red, green and blue data signals, wherein the at least one driving transistor is coupled between the first constant voltage source and the red, green and blue EL devices; and a storage element for storing the red, green and blue data signals, wherein the red, green and blue EL devices are commonly connected to the at least one driving transistor and time-divisionally emitted correspondingly to the red, green and blue data signals time-divisionally transmitted from the at least one driving transistor in response to red, green and blue emission control signals.

12. The pixel circuit of a display device according to claim 11, wherein the red, green and blue EL devices are time-divisionally driven according to corresponding said emission control signals per each sub frame inside one frame comprising at least three sub frames.

13. The pixel circuit of a display device according to claim 12, wherein the red, green and blue EL devices are time-divisionally driven in three of the at least three sub frames, the red, green and blue EL devices are independently driven in a remaining one of the at least three sub frames, or at least two EL devices are simultaneously driven in the remaining one of the at least three sub frames.

14. The pixel circuit of a display device according to claim 11, wherein white balance is controlled by controlling a light emitting time of the red, green and blue EL devices in response to corresponding said emission control signals in the respective sub frames.

15. The pixel circuit of a display device according to claim 11, wherein first electrodes of the red, green and blue EL devices are commonly connected to the at least one driving transistor, and second electrodes of the red, green and blue EL devices are commonly connected to the second constant voltage source.

16. The pixel circuit of a display device according to claim 11, wherein the red, green and blue EL devices are arranged in stripe type, delta type or mosaic type.

17. A pixel circuit of an organic electroluminescent display device comprising:

red, green and blue EL devices coupled between a first constant voltage source and a second constant voltage source;

a driving unit commonly connected to the red, green and blue EL devices to drive the red, green and blue EL devices, the driving unit comprising a driving transistor coupled between the first constant voltage source and the red, green and blue EL devices for supplying driving current to the red, green and blue EL devices; and a sequential control unit for time-divisionally controlling driving of the red, green and blue EL devices.

18. The pixel circuit of an organic electroluminescent display device according to claim 17, wherein the driving unit further comprises at least one switching transistor for switching data signals and a capacitor for storing the data signals; wherein the driving transistor supplies driving current to the red, green and blue EL devices in accordance with the data signals.

19. The pixel circuit of an organic electroluminescent display device according to claim 18, wherein the driving unit further comprises a threshold voltage compensation device for compensating a threshold voltage of the driving transistor.

20. The pixel circuit of an organic electroluminescent display device according to claim 18, wherein a power supply voltage is supplied to the driving transistor and the capacitor through a common power supply line, or the power supply voltage is supplied to the driving transistor and the capacitor through separate power supply lines.

21. The pixel circuit of an organic electroluminescent display device according to claim 17, wherein the sequential control unit comprises first, second and third control devices for time-divisionally controlling emission of the red, green and blue EL devices by controlling a supply of driving current to the red, green and blue EL devices from the driving transistor using corresponding red, green and blue emission control signals.

22. The pixel circuit of an organic electroluminescent display device according to claim 21, wherein the first, second and third control devices comprise first, second and third thin film transistors in which the corresponding emission control signals are respectively applied to gates, sources are commonly connected to the driving unit, and drains are respectively connected to the red, green and blue EL devices.

23. The pixel circuit of an organic electroluminescent display device according to claim 22, wherein white balance is controlled by controlling an active on time of the corresponding emission control signals applied to the sequential control unit, thereby controlling time in which driving current is applied to corresponding said EL devices by the first, second and third control devices.

24. The pixel circuit of an organic electroluminescent display device according to claim 17, wherein the EL devices are arranged in stripe type, delta type or mosaic type.

25. A pixel circuit of a display device comprising a plurality of pixels, the pixel circuit for realizing a certain color per display period of time and comprising at least two light emitting elements coupled between a first constant voltage source and a second constant voltage source, each said light emitting element for emitting a corresponding one of colors during a sub display period of time in the display period of time, wherein the at least two light emitting elements are sequentially driven time-divisionally during the display period of time by a driving unit comprising a driving transistor coupled between the first constant voltage source and the at least two light emitting elements, such that each said light emitting element emits the corresponding one of the colors so that the pixel circuit realizes the certain color in the display period of time.

26. The pixel circuit of a display device according to claim 25, wherein the display period of time is one frame, the sub display period of time is a sub frame, the one frame is divided into at least two sub frames, and the at least two light emitting elements are sequentially driven in accordance with the sub frames inside the one frame.

27. The pixel circuit of a display device according to claim 25, wherein the display period of time is one frame, the sub display period of time is a sub frame, the one frame is divided into at least three sub frames, the at least two light emitting elements are time-divisionally driven in accordance with at least two of the sub frames inside the one frame, and one of the at least two light emitting elements is driven again or the at least two light emitting elements are simultaneously driven in a remaining at least one of the sub frames.

28. The pixel circuit of a display device according to claim 25, wherein a light emitting time of the at least two light emitting elements is controlled to control white balance.

29. A pixel circuit of a display device comprising a plurality of pixels, the pixel circuit for realizing a certain color during a display period of time, and comprising at least two light emitting elements coupled between a first constant voltage source and a second constant voltage source, each said light emitting element for emitting a corresponding one of colors during the display period of time, wherein the pixel circuit realizes the certain color during the display period of time by emitting one of the at least two light emitting elements for a sub display period of time, such that the at least two light emitting elements time-divisionally emit the corresponding ones of the colors during the display period of time in accordance with a driving unit comprising a driving transistor coupled between the first constant voltage source and the at least two light emitting elements.

30. The pixel circuit of a display device according to claim 29, wherein the display period of time is one frame, the sub display period of time is a sub frame, the one frame is divided into at least two sub frames, and the at least two light emitting elements are time-divisionally driven in accordance with the at least two sub frames inside the one frame.

31. The pixel circuit of a display device according to claim 30, wherein a light emitting time of the at least two light emitting elements is controlled to control white balance.

32. The pixel circuit of a display device according to claim 29, wherein the display period of time is one frame, the sub display period of time is a sub frame, the one frame is divided into at least three sub frames, the at least two light emitting elements are time-divisionally driven in accordance with at least two of the sub frames inside the one frame, and one of the at least two light emitting elements is driven again or the at least two light emitting elements are simultaneously driven in a remaining one of the sub frames.

33. A display device comprising:

a plurality of pixels, each said pixel comprising red, green and blue EL devices coupled between a first constant voltage source and a second constant voltage source, and at least one thin film transistor coupled between the first constant voltage source and the red, green and blue EL devices to drive the red, green and blue EL devices, wherein the red, green and blue EL devices of each said pixel comprise first electrodes commonly coupled to the at least one thin film transistor and second electrodes commonly connected to the second constant voltage source, and the red, green and blue EL devices are time-divisionally emitted by the at least one thin film transistor in each said pixel.

34. The display device according to claim 33, wherein the red, green and blue EL devices are time-divisionally driven inside one frame comprising at least three sub frames, in accordance with the sub frames.

35. The display device according to claim 33, wherein the pixels are arranged in stripe type, delta type or mosaic type.

36. A flat panel display device comprising:

a plurality of gate lines, data lines and power supply lines; and a plurality of pixels, each said pixel connected to a corresponding said gate line, a corresponding said data line and a corresponding said power supply line, wherein each of the pixels comprises red, green and blue EL devices coupled between a first constant voltage source and a second constant voltage source; at least one thin film transistor commonly coupled between the first constant voltage source and the red, green and blue EL devices to time-divisionally drive the red, green and blue EL devices; and red, green and blue emission controlling thin film transistors connected between the at least one thin film transistor and the red, green and blue EL devices, respectively, to control the red, green and blue EL devices so that the red, green and blue EL devices are time-divisionally emitted inside one frame comprising a plurality of sub frames, in accordance with the sub frames.

37. A flat panel display device comprising:

a pixel part comprising a plurality of gate lines, data lines, emission control lines and power supply lines; and a plurality of pixels, each said pixel connected to a corresponding said gate line, a corresponding said data line, a corresponding said emission control line and a corresponding said power supply line;

at least one gate line driving circuit for supplying a plurality of scan signals to the gate lines;

at least one data line driving circuit for time-divisionally supplying red, green and blue data signals to the data lines; and at least one emission control signal generating circuit for supplying emission control signals to the emission control lines, wherein each of the pixels comprises red, green and blue EL devices coupled between a first constant voltage source and a second constant voltage source, at least one thin film transistor commonly coupled between the first constant voltage source and the red, green and blue EL devices to time-divisionally drive the red, green and blue EL devices, and red, green and blue emission controlling thin film transistors connected between the at least one thin film transistor and the red, green and blue EL devices to control the red, green and blue EL devices so that the red, green and blue EL devices are time-divisionally emitted inside one frame comprising a plurality of sub frames, in accordance with the sub frames.

38. The flat panel display device according to claim 37, wherein at least one of the gate line driving circuit, the data line driving circuit and the emission control signal generating circuit has a redundancy function.

39. A method for driving a flat panel display device comprising a plurality of gate lines, data lines and power supply lines; and a plurality of pixels, each said pixel connected to a corresponding said gate line, a corresponding said data line and a corresponding said power supply line, wherein each of the pixels comprises at least red, green and blue EL devices coupled between a first constant voltage source and a second constant voltage source, the method comprising: time-divisionally supplying at least red, green and blue data during a display period of time per a sub display period of time through a same data line to a driving unit in each said pixel, so that the at least red, green and blue EL devices are sequentially driven to realize a certain color in the display period of time, wherein the driving unit comprises a driving transistor between the first constant voltage source and the at least red, green and blue EL devices.

40. A method for driving a flat panel display device comprising a plurality of gate lines, data lines and power supply lines; and a plurality of pixels, each said pixel connected to a corresponding said gate line, a corresponding said data line and a corresponding said power supply line, wherein each of the pixels comprises at least red, green and blue EL devices coupled between a first constant voltage source and a second constant voltage source, and wherein a certain color is realized in a display period of time, the method comprising:

generating scan signals at the corresponding said gate line per a sub display period of time in the display period of time, time-divisionally applying at least red, green and blue data to the corresponding said data line whenever the scan signals are generated so that at least red, green and blue driving currents are generated through a driving unit, and time-divisionally driving the at least red, green and blue EL devices of the pixels connected to the corresponding said gate line using at least R, G and B emission control signals, wherein the driving unit comprises a driving transistor between the first constant voltage source and the at least red, green and blue EL devices.

41. The driving method of the flat panel display device according to claim 40, wherein the display period of time includes at least three sub display periods of time, and the at least red, green and blue EL devices are emitted one by one during the at least three sub display periods of time so that the at least red, green and blue EL devices are time-divisionally emitted during the display period of time.

* * * * *